US012571261B2

(12) United States Patent
Gleitman et al.

(10) Patent No.: US 12,571,261 B2
(45) Date of Patent: Mar. 10, 2026

(54) PULSED POWER DRILLING WITH MULTIPLE SELECTIVE DRILLING FLUIDS

(71) Applicant: Halliburton Energy Services, Inc., Houston, TX (US)

(72) Inventors: Daniel D. Gleitman, Houston, TX (US); William W. Shumway, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/187,046

(22) Filed: Apr. 23, 2025

(65) Prior Publication Data

US 2025/0250863 A1 Aug. 7, 2025

Related U.S. Application Data

(63) Continuation-in-part of application No. 18/977,394, filed on Dec. 11, 2024, now abandoned, which is a continuation of application No. 18/457,081, filed on Aug. 28, 2023, now Pat. No. 12,173,605.

(51) Int. Cl.

| | |
|---|---|
| ***E21B 7/00*** | (2006.01) |
| ***E21B 21/10*** | (2006.01) |
| ***E21B 21/12*** | (2006.01) |

(52) U.S. Cl.

CPC ..... *E21B 7/00* (2013.01); *E21B 21/10* (2013.01); *E21B 21/12* (2013.01)

(58) Field of Classification Search

CPC ..... E21B 7/00; E21B 21/10; E21B 21/12

See application file for complete search history.

(56) References Cited

U.S. PATENT DOCUMENTS

| | | | | |
|---|---|---|---|---|
| 4,436,166 | A | 3/1984 | Hayatdavoudi et al. | |
| 12,173,605 | B1 | 12/2024 | Gleitman et al. | |
| 2020/0217143 | A1 | 7/2020 | Liu et al. | |
| 2020/0300045 | A1* | 9/2020 | Jathmi | E21B 10/60 |
| 2020/0370375 | A1* | 11/2020 | Gleitman | E21B 44/00 |
| 2021/0025240 | A1 | 1/2021 | Moeny | |
| 2021/0310309 | A1* | 10/2021 | Kronman | E21B 7/15 |
| 2025/0101808 | A1 | 3/2025 | Gleitman et al. | |

FOREIGN PATENT DOCUMENTS

| | | |
|---|---|---|
| WO | 2025048856 | 3/2025 |

OTHER PUBLICATIONS

"PCT Application No. PCT/US2023/073102, International Search Report and Written Opinion", May 13, 2024, 10 pages.

* cited by examiner

*Primary Examiner* — Crystal J Lee

(74) *Attorney, Agent, or Firm* — DeLizio, Peacock, Lewin & Guerra LLP

(57) ABSTRACT

A system for pulsed power drilling a wellbore into a subsurface formation comprises a drill bit that includes at least one electrode coupled to a power source, the at least one electrode to periodically emit an electrical discharge based on electrical pulses received from the power source. The system comprises a first port to output a first type of drilling fluid having a different composition than a second type of drilling fluid to flow downhole for removal of cuttings, wherein the electrical discharge is to be transmitted through the first type of drilling fluid and through a rock of the subsurface formation, wherein an additive or a property of at least one of the first type of drilling fluid or the second type of drilling fluid reduces mixability between the first type of drilling fluid and the second type of drilling fluid.

77 Claims, 13 Drawing Sheets

PULSED POWER DRILLING WITH MULTIPLE SELECTIVE DRILLING FLUIDS

BACKGROUND

Pulsed power (or electrical) drilling uses pulsed power technology to drill a borehole in a rock formation. Pulsed power technology may repeatedly apply a high electric potential across the electrodes of a drill bit, which ultimately causes the surrounding rock to fracture. The fractured rock is carried away from the bit by drilling fluid and the bit advances downhole.

BRIEF DESCRIPTION OF THE DRAWINGS

Embodiments of the disclosure may be better understood by referencing the accompanying drawings.

DESCRIPTION

Figure 1:
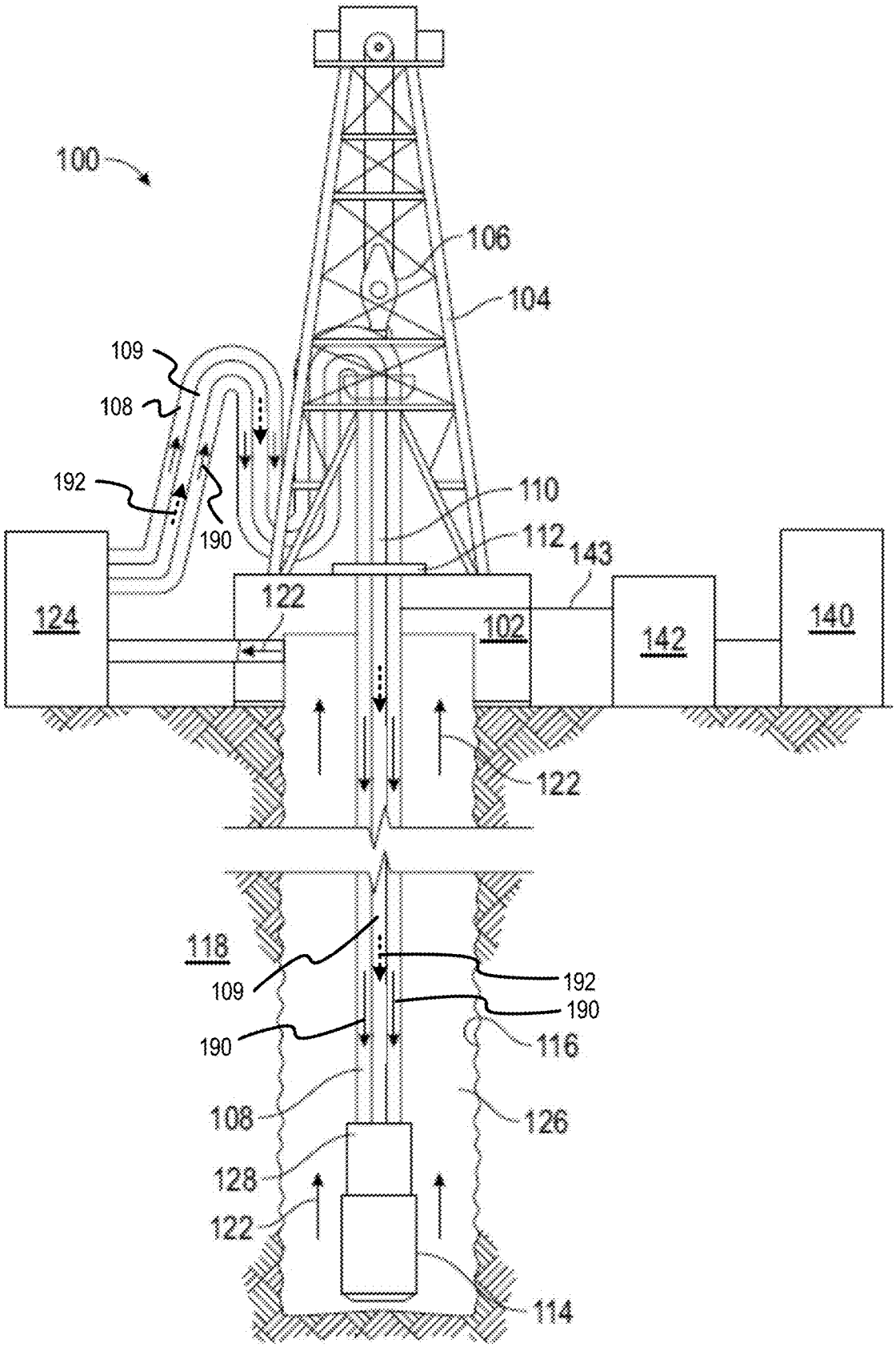
FIG. 1 is an elevation view of a pulsed power drilling system used to form a wellbore in a subterranean formation, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Pulsed power drilling, also sometimes described as plasma drilling or electric spark drilling, includes several components to create repetitive electrical arcs. Electrical power may be generated at surface and conveyed to the bottom hole assembly using a wire, and/or, may be generated downhole for example using a drilling fluid driven turbine and electrical generator. As described in U.S. Pat. No. 11,078,727 and other known references, the conveyed or generated power may be stored in capacitors, and a switching circuit may be used in the rapid discharge of the stored power, i.e. arcing, between electrodes or between an electrode and a ground ring.

The electrodes may be incorporated into a structure at the distal end of the bottom hole assembly, such structure analogous to the roller cone, PDC (polycrystalline diamond compact), TSP (thermally stable polycrystalline) or natural diamond drill bits used in traditional mechanical drilling. The term "drill bit" as used herein therefore means such a structure at the distal end of the bottom hole assembly which incorporates at least one electrode, to be used for the above noted arcing at the bottom of the hole to remove the rock and advance the depth of the hole. Example configurations of such drill bits include those described in U.S. Pat. No. 10,961,782 and may include one or more pathways or conduits through the bit for drilling fluid pumped from surface to exit proximate to the bottom of the hole being drilled, to help clear the rock cuttings from the bottom of the hole. This rock removal method is further described below and may be performed without the rotation of a bottom hole assembly (BHA) typically required with traditional mechanical drilling. While rotation is not required for pulsed power drilling, in some implementations rotation of the BHA may be employed (e.g. using a positive displacement motor above or within the BHA to rotate at least a part of the BHA, or in cases of the outer conduit being jointed pipe, with rotation from the rotary table or top drive at surface) together with the pulsed power drilling process, such rotation for purposes distinct from destroying the rock to advance the hole, for example to keep cuttings in the anulus mobilized, reduce frictional drag, or for negating the steering tendencies of a BHA configured to drill directionally. In certain implementations, carbide buttons, diamonds, Polycrystalline Diamond Compact (PDC), Thermally Stable Polycrystalline (TSP) cutters or other hard materials may be incorporated together with electrodes into the pulsed power bit, and rock removal may be accomplished by mechanical destruction of rock at the bottom of the hole utilizing the rotation described above, in combination with, or alternating with, or in a selective process between (e.g. depending upon rock type), the electrical arcing techniques. Some implementations may also include one or more nozzles or jets within the bit, for the drilling fluid to exit and impinge the bottom of the hole at high velocity, to aid in rock removal.

The pulsed power drilling approaches described herein may be implemented with any of the drill bit approaches described.

Pulsed power drilling generally may incorporate a drilling fluid having certain oil based muds with high enough dielectric strength and dielectric constant to drive the electric field and arc from the drill bit into the rock (as opposed to shorting through the drilling fluid). There is a challenge in achieving this mode of pulsed power drilling (i.e., arcing through the rock) with water-based drilling fluids-because such fluids are typically conductive. There is also significant challenge in creating an oil-based drilling fluid with sufficient properties for pulsed power drilling while maintaining adequate fluid properties for other aspects of drilling (such as mud weight, fluid viscosity, fluid loss properties, fluid stability, etc.).

For pulsed power drilling, multiple pulses may be generated at or near a face of the drill bit between an electrode and a ground structure or different electrode. These pulses and corresponding arcs may occur between 50 and 500 times per second. The arcs may have a duration of between 0.1 and 100 microseconds. Some pulsed power drilling systems may use a water-based drilling fluid. However, such systems are designed to arc through the fluid itself, or along the face of the bottom of the hole, rather than arcing through the rock below the surface of the rock at bottom of the hole. This is due to the conductivity of the water based fluids being higher than of the rock (technically because the dielectric constant being too low as compared to that of the rock). Example implementations may include pulsed power systems designed to pulse through the fluid, along the surface of the bottom of the hole, or through the rock itself. Arcing through the rock, as is also known with certain oil based fluids, removes rock more efficiently than the hydrodynamic shock and/or heating mechanism of arcing through the fluid above the rock. However, (in contrast to conventional approaches) example embodiments may include both the use of a water-based drilling fluid, with its particular benefits in the drilling process, together with arcing through the rock, with its benefits for efficient rock removal.

In particular, a pulsed power drilling system removes rock most efficiently when the electric field between the electrodes or electrode and ground structure (and resultingly, the arc) is driven into the rock at or near the bottom of the wellbore. This field geometry and arc path requires that the rock in the surrounding subsurface formation have lower dielectric properties than the drilling fluid surrounding the electrode.

Thus, example implementations may use water-based drilling fluids. Some embodiments may use at least two different types of drilling fluids. For example, in some implementations, a first type of drilling fluid with appropriate dielectric characteristics may be used immediately proximate to the drill bit (electrodes/ground structure), and a second type of drilling fluid with substantially different dielectric characteristics may be used for other parts of the drilling (such as the circulation system for returning cuttings to the surface, etc.).

Examples of the first type of drilling fluid to be used immediately proximate to the drill bit may include at least one of BaraPure™, glycerin, an organic carbonate fluid dielectric oil, ethanol, or other known high-dielectric-property fluids. Examples of the second type of drilling fluid for the circulating system may be oil-based, brine-based, water-based, etc. In some implementations, the first type of drilling fluid may be a water-based drilling fluid that may include glycerin, ethanol, or other liquids which are not oils and may be acceptable as additives (or easy to remove from the water-based drilling fluid)—thereby being a dielectric drilling fluid. BaraPure™, as used herein, is an invert emulsion fluid product marketed by Halliburton, comprising an organic, aqueous compatible, internal phase that is hygroscopic and nominally contains little or no salt, in place of the typical brine internal phase of an invert emulsion drilling fluid, and which may be particularly formulated and with dielectric properties in accordance with any of U.S. Pat. Nos. 10,557,072, 10,557,073, 10,435,610, and 10,316,237.

In some implementations, there is also mechanical configuration to provide the first type of drilling fluid immediately proximate to the drill bit while using the second type of drilling fluid for the other parts (e.g., fluid column uphole from the drill bit) of the pulsed power circulation system. In such implementations, the first type of fluid may be provided at a minimum in the drill bit face, in the path of the pulse power arc from electrode to electrode or electrode to ground ring. However, the first type of fluid may also be provided in a larger volumetric region, encompassing the region noted above at the drill bit face, plus the volume associated with a distance within the annulus between BHA or pipe and borehole wall. For example, some implementations may include a coil-in-coil conveyance of the two different types of drilling fluids from the surface of the wellbore to downhole. The coil-in-coil conveyance may include an inner coil tubing and an outer coil tubing that houses the inner coil tubing. The inner coil tubing and the outer coil tubing may run from a surface of the wellbore downhole to the bottom hole assembly (BHA) that includes a drill bit.

While described such that the two different types of drilling fluids are delivered downhole using a coil-in-coil conveyance, some implementations may perform this delivery using other types of conveyances. For example, other types of conduits (such as jointed drill pipe) may be used for delivery of at least one of the drilling fluids. In some implementations, one of the conveyances is not housed in the other conveyance. For example, two different coiled tubings may be used but not configured such that one is housed in the other. In other implementations, an inner string of jointed pipe may be run inside of an outer string of jointed pipe, or a coiled tubing may be run inside of an outer string of jointed drill pipe. In some implementations, one or both of the inner and outer conduits may be a hybrid string with jointed pipe at the distal end, with coiled tubing above, as described in U.S. Pat. No. 10,407,992.

The inner coil tubing may include conveyance of the first type of drilling fluid from the surface of the wellbore to a location at or near the at least one electrode of the drill bit. The first type of drilling fluid may have a higher dielectric than the rock of the surrounding subsurface formation, or any combination of material properties that is less preferential to electrical flow (and preferably, less preferential to pulsed electrical flow or arcing of 1 to 100 microseconds duration), than the combination of material properties of the rock of the surrounding subsurface formation.

In some implementations, one or more electrical cables or optical fibers for power, communications, and/or control may be also conveyed. between the surface of the wellbore and the BHA, along the exterior and/or strapped to one of the pipe or coiled tubing strings, incorporated within the wall of a pipe or tubing, or within the inner pipe or coiled tubing. Such wire or fiber may be included within an umbilical, which itself may include a coating or armor for strength and protection from the drilling fluid.

In some implementations, certain gases (such as nitrogen (N 2)) may have sufficient dielectric properties for the purpose described above, and may be conveyed down this inner coil tubing or inner conduit. After passing through the first port and providing a relatively high dielectric fluid region at the bit, the bubbles from these gases may return to the surface of the wellbore through the annulus within the second type of drilling fluid. This combination of gases and the second type of drilling fluid may be managed as is known in certain underbalanced drilling or managed pressure drilling scenarios. Coiled tubing drilling may make pressure control and fluids management simpler, as it is easier to seal on the outer diameter of continuous coil than on variable outer diameter of drill pipe.

Accordingly, example implementations may enable more efficient drilling by separating the critical dielectric element fluid from the bulk drilling fluid. The bulk drilling fluid may have different viscosity, density, equivalent circulation density (ECD) management, fluid loss control, formation interaction properties, etc. Additionally, example implementations may result in a lower cost application as cheaper drilling fluid systems may be used for the bulk of the fluid column, leaving only the portion surrounding the bit to be a more expensive specialized fluid. Reserving the high dielectric fluid for the region of the drill bit as described herein may also have advantages in environmental compliance, as water-based fluids may be easier or less expensive for environmental compliance than the specialized fluid. By separating the pulsed power drilling from the other missions of the drilling fluid, via incorporation of different drilling fluids (as described herein), example implementations may result in deeper drilling with the pulsed power system, or into highly pressured areas that may not be suitable with the current pulsed power drilling fluid design as the single fluid system.

In some implementations, the second type of drilling fluid may be conveyed down the larger cross section of the outer coil tubing or conduit (i.e. in the annular area between inner coil tubing/conduit and outer coil tubing/conduit) as compared to the inner coil tubing or conduit. In some implementations, the second type of drilling fluid may be conveyed down the wellbore via reverse circulation-down the annulus between the wall of the wellbore and the outer coil tubing or conduit, and returned to surface together with the flow of the first type of drilling fluid via the annular area between inner coil tubing/conduit and outer coil tubing/conduit.

In some implementations, a volumetric flow rate of the first type of drilling fluid is smaller than a volumetric flow rate of the second type of drilling fluid. The second type of drilling fluid may have the substantial engagement with the wellbore being drilled (providing the hole cleaning, pressure management, and formation compatibility properties as is routine for the conventional drilling fluid). This second type of drilling fluid may be water-based, oil-based, brine-based, etc. In some implementations, a smaller volume of the first type of drilling fluid may be conveyed from the surface of the wellbore via the smaller inner coil tubing, and a comparably isolated pathway through the BHA, and output at one or more ports of the face of the drill bit. Such port or ports may include fluid nozzles or jets.

Thus, example implementations may be used for arcing at the face of the drill bit face in presence of predominantly the dielectric drilling fluid (even with the higher volumetric flow rate in the wellbore/outer conduit annulus of the second type of drilling fluid). In some implementations, the second type of drilling fluid circulating through the outer coil tubing and into the wellbore annulus (or vice versa if in a reverse circulation) may be output via a port between an interior and an exterior of the outer conduit string or preferably the BHA (above a face of the drill bit). For example, the port may be positioned in a range of 1-2 inches (or less) above the face of the drill bit. Such a position of this port may ensure the arc from the bit face electrodes does not seek a short circuit through the second type of drilling fluid. The first type of drilling fluid, at a relatively smaller volumetric flow rate, may be the sole fluid present in the small volume surrounding the electrode (and ground structure) where the arc is launched and received. The flow rate of the first type of drilling fluid would still be sufficient for the immediate clearing of cuttings from the bit face area, and to the fluid interface with the second type of drilling fluid. The port may be positioned higher along the BHA, or higher yet in the outer conduit, for greater assurance of the first type of drilling fluid being at the bit face area even in cases of the drill bit having minor up/down motions relative to the bottom of the hole, e.g. as instigated at surface for hole cleaning purposes, or a mixing zone of the first and second fluid when the drilling fluid pump at surface is cycled on/off/on for various reasons.

In some implementations, at least one of an outer diameter of the ground structure (e.g., the ground ring) or a gage section of the drill bit may be coated with a material (e.g. a ceramic, glass, or a polymer) that is electrically insulative. In some implementations, a tortuous path may be created between the face of the drill bit and the annulus of the wellbore to minimize contamination of the area around the face of the drill bit by the second type of drilling fluid. In some implementations, a pressure gradient may be created from the face of the drill bit and the annulus to minimize contamination of the area around the face of the drill bit by the second type of drilling fluid. In some implementations such tortuous path may be created by an OD section on the drill bit or higher in the BHA or string which is dimensionally close to (but less than) the ID of the hole being drilled thus restricting the flow and resulting in a pressure drop over the tortuous path, and/or with slots or holes, axial or helical, on such upset for such flow. In some implementations, a rotor may be positioned between the first port to output the first type of drilling fluid and the one or more drilling fluid ports to output the second type of drilling fluid. For example, a rotor may be positioned on the BHA between the face of the drill bit and the one or more ports to output the bulk drilling fluid. The rotor may rotate to limit the movement of the bulk drilling fluid downward toward the face of the drill bit. This rotation may be driven by an electric motor or otherwise driven relative to the BHA or may result from vanes (e.g. helical vanes) integral with the BHA and which rotate relative to the hole with the BHA, in cases where the BHA itself has rotation relative to the hole.

In some implementations, at least one port (or plurality of ports) at or near a face of the drill bit (a first port) may be used for outputting the first type of drilling fluid, wherein all or at least a portion of the second type of drilling fluid also using this same port. In some implementations, one or more valves may be used to meter one or the other of the first type and second type of drilling fluids or both being output from this same port. Such metering (and using this same port) may be employed to provide a dielectric fluid presence during the build of the charge and discharge of the arc and providing the water based fluid to clean the bottom of the hole at other times. The valves may be ball valves, poppet valves, gate valves, or other types of valves known for use downhole with drilling fluid.

The opening and closing of the valves may be powered and controlled electrically via a controller resident in the BHA, and/or, from a controller at surface via electrical or other power or communications link. Such controller may also have an input signal related to the pulsed power arc timing. The duty cycle nature of the pulsed power process may support such alternating of the drilling fluids. A valve or set of valves may be employed at or near the drill bit to synchronize with the electrical pulsing. For example, the actual electrical pulse may comprise on the order of 0.01% to 2% of the time of each cycle and therefore most of the time the valve may be controlled to establish a flow path to output to the first port the second type of drilling fluid, and for the relatively short period of time each cycle associated with the electrical arcing, to adjust the valve(s) to establish a flow path to output to the first port predominantly the first type of drilling fluid. The alternating of first fluid vs second fluid may be timed to recognize the time required for the first type of drilling fluid to displace the second type of fluid at the face of the drill bit, which may be a significantly greater proportion of the duty cycle time than the short time of the arc itself. The valves, flow paths, and volumetric rates pumped from service may be tailored such that the volumetric flow rates to the bit face of second fluid type to the bit face may be different from the volumetric flow rate to the bit face of the first type of fluid, for the time periods within the duty cycle of each of the two respective flows. And thus even if the time periods are approximately equal (i.e. a 50/50 duty cycle), the overall volumetric flows over time may be unequal. In such implementations of alternating of two drilling fluid types to the drill bit face, the second type of drilling fluid may also be ported to the borehole annulus, such port above the bit face (e.g. through the BHA or through an outer conduit higher in the string), with or without restriction, and/or with a valve whose opening and closing may be coordinated with the valve controlling flow of the second fluid to the drill bit face. In such a manner, the second fluid flow from surface may be relatively continuously flowing into the annulus, even with a non-continuous flowing to the drill bit face. Instead of or in addition to a controller for such valve actions having a synchronizing input relating to the pulsed power arc timing, a controller (in the BHA or surface) may be used to control the timing of the pulsed power arc with an input reflecting the state(s) of the valve(s), to achieve the desired synchronization.

In some implementations, the first type of drilling fluid employed at lower volumetric flow rates may be oil-based or other chemistries which then return to a surface of the wellbore as a non-continuous phase within the second type of drilling fluid (that may be water-based), which may then be separated at the surface. Accordingly, the second type of drilling fluid may still be in continuous phase and may still dominate the properties important to cuttings removal, wellbore maintenance, pressure control, etc.

In some implementations, water, for example deionized water, may be employed as (or as a component of) the first type of drilling fluid, e.g. as a dielectric fluid. In using water, the mixing back with another water based drilling fluid (the second type of drilling fluid) represents just a small dilution to that second drilling fluid, which can be addressed at surface in a routine manner to restore desired density and other properties.

Additionally, as further described below, some implementations may include separation or minimized mixing of the multiple drilling fluids. Such separation and minimization of mixing of the different types of drilling fluids may be enabled by separate flow paths downhole and back to the surface of the wellbore. Alternatively or in addition, some implementations may include surface separation which may be enabled by the particular compositions of the two different types of drilling fluids.

In some implementations, deionized water may be pumped from the surface down the inner coil tubing or conduit. In some implementations, fresh water may be pumped from the surface, and known deionization processes may be employed downhole (e.g. within the BHA) to create the deionized water required for its dielectric properties at the electrode face. Deionized water may be corrosive. Industrial grade systems for deionizing continuously flowing water are widely available e.g. from Culligan Industrial Solutions and other suppliers. Other treating steps are also known and may be used in a train with (typically prior to) the deionization step, to adjust water with contaminants to a fresh-water level appropriate for input to the deionization step. Accordingly, in some implementations, the inner diameter of the inner coil tubing or conduit and/or the first port and other surfaces the deionized water is conveyed through may include special coatings (e.g. Teflon), or may be made of a non-reactive material, to mitigate the corrosive effects.

While described in reference to coil tubings, some implementations may use any type of conduit for communication of the different types of drilling fluids. For example, a drill pipe within a drill pipe may be used. Alternatively, an inner coil tubing may be within a drill pipe to provide the dual conveyance (as further described herein). While the term "port" is used for the flowing of the drilling fluids out and/or in different parts of the drill string (such as the drill bit), example implementations may use any type of orifice, opening, aperture, outlet/inlet, passage, hole, nozzle or other shaped features for this outputting and/or inputting of the drilling fluids.

EXAMPLE SYSTEMS

FIG. 1 is an elevation view of a pulsed power drilling system used to form a wellbore in a subterranean formation, according to some embodiments. Although FIG. 1 shows land-based equipment, downhole tools incorporating example implementations may be satisfactorily used with equipment located on offshore platforms, drill ships, semi-submersibles, and drilling barges (not expressly shown). Additionally, while a wellbore 116 is shown as being a generally vertical wellbore, the wellbore 116 may be any orientation including generally horizontal, multilateral, or directional. References herein such as "above" and "below" in relation to the pulsed power drilling system or components thereof, or the borehole, are to be recognized as reflecting a vertical wellbore orientation, with the "down" direction being understood as towards the distal end of the system or borehole, regardless of actual orientation.

Example implementations may use water-based drilling fluids. Some embodiments may use at least two different types of drilling fluids. For example, in some implementations, a first type of drilling fluid with appropriate dielectric characteristics may be used immediately proximate to the drill bit (electrodes/ground structure), and a second type of drilling fluid with substantially different dielectric characteristics may be used for other parts of the drilling (such as the circulation system for returning cuttings to the surface, etc.).

Figure 2:
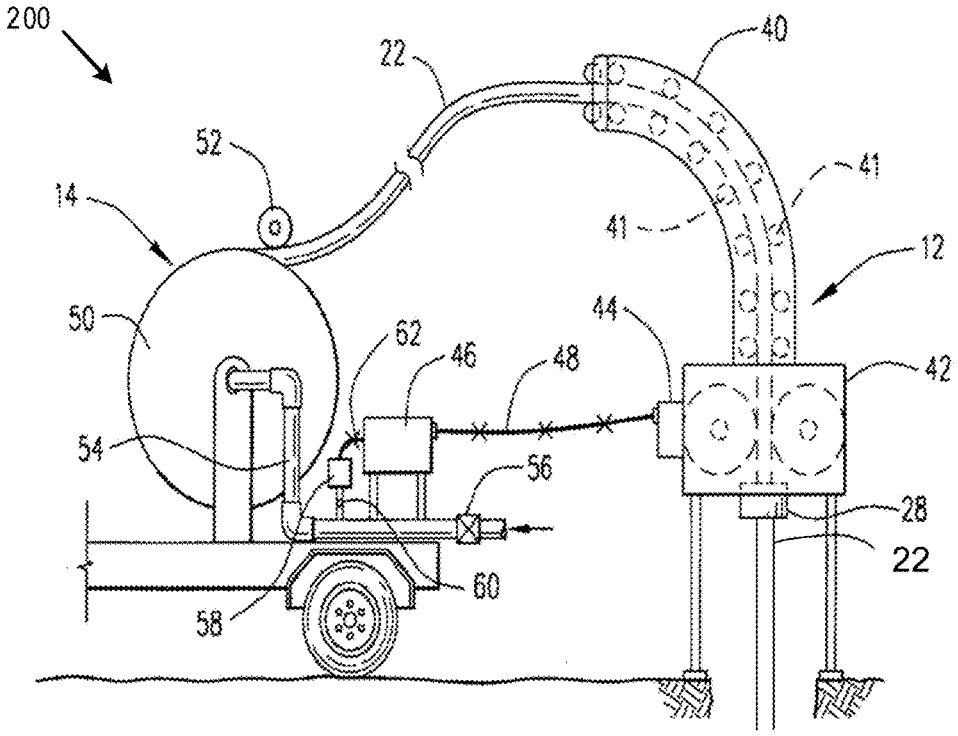
FIG. 2 is an elevation view of a dual coil tubing and coiling tubing injector for a pulsed power drilling system used to form a wellbore in a subterranean formation, according to some embodiments.

A drilling system 100 includes a drilling platform 102 that supports a derrick 104 having a traveling block 106 for raising and lowering a dual tubing conveyance that may include an inner coil tubing 109 that is housed within an outer coil tubing 108. For example, some implementations may include a coil-in-coil conveyance of the two different types of drilling fluids from the surface of the wellbore to downhole. The inner coil tubing 109 and the outer coil tubing 108 may run from a surface of the wellbore 116 downhole to the bottom hole assembly (BHA) that includes a drill bit 114. While FIG. 1 depicts a coiled tubing in conjunction with a derrick, in some implementations, the coiled tubing may be coupled to a coiled tubing injector and around a coiled tubing reel at the surface of the wellbore. An example of such a system is depicted in FIG. 2 (which is further described below).

The inner coil tubing 109 may include conveyance of a first type of drilling fluid 192 from the surface of the wellbore 116 to a location at or near the at least one electrode of the drill bit 114. The first type of drilling fluid 192 may have a higher dielectric than the rock of the surrounding subsurface formation. Examples of the first type of drilling fluid 192 to be used immediately proximate to the drill bit 114 may include at least one of BaraPure™, glycerin, an organic carbonate fluid dielectric oil, ethanol, or other known high-dielectric-property fluids. In some implementations, the first type of drilling fluid 192 may be a water-based drilling fluid that may include glycerin, ethanol, or other liquids which are not oils and may be acceptable as additives (or easy to remove from the water-based drilling fluid)—thereby being a dielectric drilling fluid.

In some implementations, the inner coil tubing 109 may also house one or more cables for power, communications, etc. between the surface of the wellbore and the BHA. In some implementations, certain gases (such as nitrogen ($N_2$)) may have sufficient dielectric properties to be conveyed down the inner coil tubing 109. After passing through the first port, the bubbles from these gases may return to the surface of the wellbore through the annulus within the second type of drilling fluid. This combination of gases and the second type of drilling fluid may be managed as is known in certain underbalanced drilling or managed pressure drilling scenarios. In some implementations, water (such as deionized water) may also be conveyed down the inner coil tubing 109.

The outer coil tubing 108 may include conveyance of a second type of drilling fluid 190 from the surface of the wellbore 116 to a location at or near the at least one electrode of the drill bit 114 and/or a location above the drill bit 114. Examples of the second type of drilling fluid 190 for the circulating system may be oil-based, brine-based, water-based, etc. As compared to the first type of drilling fluid 192, the second type of drilling fluid 190 may be a bulk drilling fluid that may have different viscosity, density, equivalent circulation density (ECD) management, fluid loss control, formation interaction properties, etc. Accordingly, example implementations may enable more efficient drilling by separating the critical dielectric element fluid (the first type of drilling fluid 192) from the bulk drilling fluid (the second type of drilling fluid 190).

Additionally, example implementations may result in a lower cost application as cheaper drilling fluid systems may be used for the bulk of the fluid column (the second type of drilling fluid 190), leaving only the portion surrounding the bit to be a more expensive specialized fluid (the first type of drilling fluid 192). By separating the pulsed power drilling incorporation of different drilling fluids (as described herein), example implementations may result in deeper drilling with the pulsed power system, or into highly pressured areas that may not be suitable with the current pulsed power drilling fluid design as the single fluid system. Also, coiled tubing drilling may make pressure control and fluids management simpler, as it is easier to seal on the outer diameter of a continuous coil than on variable outer diameter of drill pipe.

In some implementations, water may be employed as the dielectric fluid (the first type of drilling fluid 192). In using water, the mixing back with the water based drilling fluid (the second type of drilling fluid 190) represents just a small dilution, which can be addressed at surface in routine manner to restore desired density and other properties. In some implementations, deionized water may be pumped from the surface down the inner coil tubing 109. In some implementations, fresh water may be pumped from the surface, and known deionization processes may be employed downhole to create the deionized water required for its dielectric properties at the electrode face. Deionized water may be corrosive. Accordingly, in some implementations, the inner diameter of the inner coil tubing 109 and/or the first port and other surfaces the deionized water is conveyed through may include special coatings to mitigate the corrosive effects.

The drilling system 100 also includes one or more pumps 124, which circulates the first type of drilling fluid 192 and the second type of drilling fluid 190 through a feed pipe to the inner coil tubing 109 and the outer coil tubing 108. In some implementations, each of the first type of drilling fluid 192 and the second type of drilling fluid 190 has its own pump 124 for pumping the associated drilling fluid through the inner coil tubing 109, and the outer coil tubing 108, respectively. The inner coil tubing 109 and the outer coil tubing 108 may convey the first type of drilling fluid 192 and the second type of drilling fluid 190, respectively, downhole and through one or more ports or orifices at or near the drill bit 114. Thus, in some implementations, the second type of drilling fluid 190 may be conveyed down the larger cross section of the outer coil tubing 108 (i.e. in the annular area between the inner coil tubing 109 and the outer coil tubing 108) as compared to the inner coil tubing 109. In some implementations, the second type of drilling fluid 190 may be conveyed down the wellbore 116 via reverse circulation-down the annulus between the wall of the wellbore 116 and the outer coil tubing 108.

In some implementations, a volumetric flow rate of the first type of drilling fluid 192 may be smaller than a volumetric flow rate of the second type of drilling fluid 190. The second type of drilling fluid 190 may have the substantial engagement with the wellbore being drilled (providing the hole cleaning, pressure management, and formation compatibility properties as is routine for the conventional drilling fluid). The second type of drilling fluid 190 may be water-based, oil-based, brine-based, etc. In some implementations, a smaller volume of the first type of drilling fluid 192 may be conveyed from the surface of the wellbore via the smaller inner coil tubing 109, and a comparably isolated pathway through the BHA, and output at a port of the face of the drill bit 114. In some implementations, the first type of drilling fluid 192 employed at lower volumetric flow rates may be oil-based or other chemistries which then returns to a surface of the wellbore 116 as a non-continuous phase within the second type of drilling fluid 190 (that may be water-based), which may then be separated at the surface. Accordingly, the second type of drilling fluid 190 may still be in continuous phase and may still dominate the properties important to cuttings removal, wellbore maintenance, pressure control, etc.

A drilling fluid 122 then circulates back to the surface via an annulus 126 formed between the outer coil tubing 108 and the sidewalls of the wellbore 116. The drilling fluid 122 may be a combination of the first type of drilling fluid 192 and the second type of drilling fluid 190. Fractured portions of the formation may be carried to the surface by the drilling fluid 122 to remove those fractured portions from the wellbore 116.

The drill bit 114 may be part of a bottom hole assembly (BHA) 128 coupled to the outer coil tubing 108 and the inner coil tubing 109. In some embodiments, power to the drill bit 114 may be supplied from the surface. For example, a generator 140 may generate electrical power and provide that power to a power conditioning unit 142. The power conditioning unit 142 may then transmit electrical energy downhole via a surface cable 143 and a subsurface cable (not expressly shown in FIG. 1). In some implementations, the subsurface cable may be housed in the inner coil tubing 109.

A pulse generating circuit within the BHA 128 may receive the electrical energy from power conditioning unit 142 and may generate high-energy pulses to drive the drill bit 114. The pulse generating circuit within the BHA 128 may be utilized to repeatedly apply a high electric potential, for example up to or exceeding 150 kilo volts (kV), across the electrodes of the drill bit 114. Each application of electric potential may be referred to as a pulse. When the electric potential across the electrodes of the drill bit 114 is increased enough during a pulse to generate a sufficiently high electric field, an electrical arc may be formed through a rock formation at the bottom of the wellbore 116. The arc temporarily forms an electrical coupling between the electrodes of the drill bit 114, allowing electric current to flow through the arc inside a portion of the rock formation at the bottom of the wellbore 116. The arc may greatly increase the temperature and pressure of the portion of the rock formation through which the arc flows and the surrounding formation and materials. The temperature and pressure are sufficiently high to break the rock itself into small bits or cuttings. This fractured rock may be removed, typically by the first type of drilling fluid 192 and the second type of drilling fluid 190, which moves the fractured rock away from the electrodes and uphole.

As the drill bit 114 repeatedly fractures the rock formation and the drilling fluid 122 moves the fractured rock uphole, the wellbore 116, which penetrates various subterranean rock formations 118, is created. The wellbore 116 may be any hole drilled into a subterranean formation or series of subterranean formations for the purpose of exploration or extraction of natural resources such as, for example, hydrocarbons, or for the purpose of injection of fluids such as, for example, water, wastewater, carbon dioxide, brine, or water mixed with other fluids. Additionally, the wellbore 116 may be any hole drilled into a subterranean formation or series of subterranean formations for the purpose of geothermal power generation.

The drill bit 114 may be any type of electrical-based bit. For example, the drill bit 114 may be an electrocrushing drill bit, an electrohydraulic drill bit, etc. An electrohydraulic drill bit may have one or more electrodes and ground ring similar to an electrocrushing drill bit. But, rather than generating an arc within the rock, an electrohydraulic drill bit applies a large electrical potential across the one or more electrodes and ground ring to form an arc across the drilling fluid proximate the bottom of the wellbore 116. The high temperature of the arc vaporizes the portion of the fluid immediately surrounding the arc, which in turn generates a high-energy shock wave in the remaining fluid. The one or more electrodes of electrohydraulic drill bit may be oriented such that the shock wave generated by the arc is transmitted toward the bottom of the wellbore 116. When the shock wave hits and bounces off of the rock at the bottom of the wellbore 116, the rock fractures. Accordingly, the drilling system 100 may utilize pulsed-power technology with an electrohydraulic drill bit to drill the wellbore 116 in the subterranean formation 118 in a similar manner as with electrocrushing drilling.

In some implementations, the drilling system 100 may also include a tractor or mechanical means of moving the drill bit. Such implementations may be necessary with the use of coil tubing drilling because of the inability to add weight on bit to such a drill string (as is typically done in a traditional drilling system using drill pipe).

In some implementations, a system independent of a derrick may include dual coil tubing. For example, FIG. 2 is an elevation view of a dual coil tubing and coiling tubing injector for a pulsed power drilling system used to form a wellbore in a subterranean formation, according to some embodiments.

A system 200 includes a coil tubing injector 12 and a truck mounted coil tubing reel assembly 14 at a surface of a wellbore 16. A length of coil tubing 22 is inserted in the wellbore 16 and may be coupled to a BHA (similar to the system 100 of FIG. 1) In some implementations, the coil tubing 22 may be dual coil tubing (with an inner coil tubing and an outer coil tubing) (as described above in reference to FIG. 1). While the reel assembly 14 is depicted as being part of a truck, in some implementations, the reel assembly 14 for the coil tubing may be off a boat or ship as part of an offshore drilling operation. The coil tubing 22 may be inserted into the wellbore 16 by way of a stuffing box 28. The fluid circulated into the wellbore 16 by way of the coil tubing 22 may be returned to the surface of the wellbore 16 via an annulus from where it is routed to a pit, tank or other fluid accumulator (not shown).

The coiled tubing injector 12 straightens the coil tubing 22 and injects it into wellbore 16 by way of the stuffing box 28. The coil tubing injector 12 may comprise a straightening mechanism 40 having a plurality of internal guide rollers 41 therein and a coil tubing drive mechanism 42 for inserting the coil tubing 22 into the wellbore 16, raising it or lowering it within the wellbore 16 and removing it from the wellbore 16 as it is rewound on a reel 50 of the assembly 14. A depth measuring device 44 may be connected to the coil tubing drive mechanism 42. The depth measuring device 44 may continuously measure the length of coil tubing 22 injected into the wellbore 16 and may provide that information by way of an electric transducer (not shown) and an electric cable 48 to an electronic data acquisition system 46. The truck mounted reel assembly 14 includes the reel 50 for containing coils of the coil tubing 22. A guide wheel 52 for guiding the coil tubing 22 on and off the reel 50 is provided and a conduit assembly 54 is connected to the end of coil tubing 22 on the reel 50 by way of a swivel system (not shown).

A shut-off valve 56 is disposed in the conduit assembly 54 and the conduit assembly 54 is connected to a fluid pump (not shown) which pumps the fluid to be circulated from a pit, tank or other fluid accumulator through the conduit assembly 54 and into the coil tubing 22. A fluid pressure sensor 58 or equivalent device is connected to the conduit assembly 54 by way of a connection 60 attached thereto and to data acquisition system 46 by an electric cable 62. The data acquisition system 46 may function to continuously record the depth of coil tubing 22 attached thereto in the wellbore 16 and the surface pressure of the fluid being pumped through coil tubing 22.

Example Bottom Hole Assemblies

Figure 3:
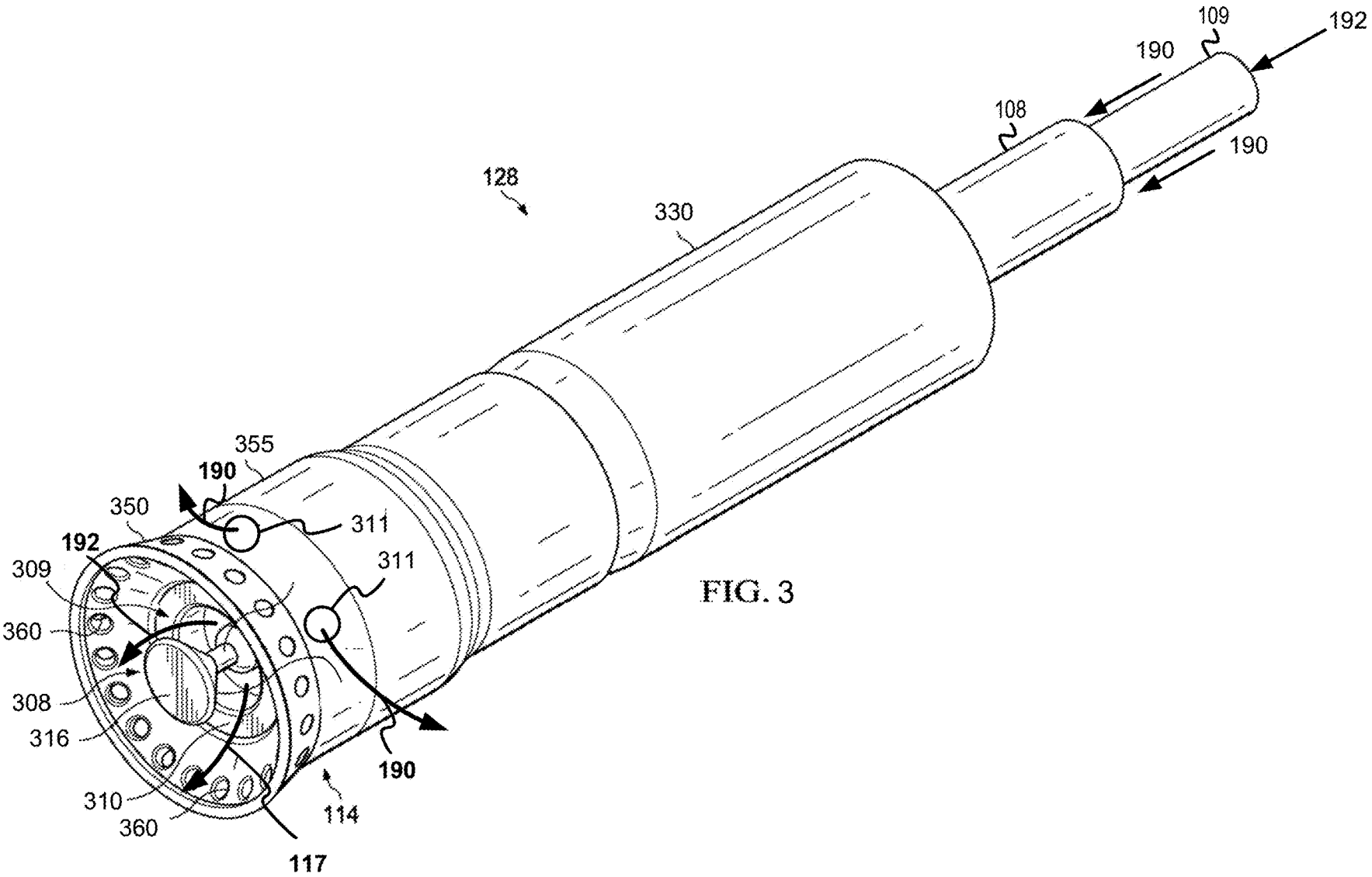
FIG. 3 is a perspective view of a first example bottom hole assembly for downhole pulsed power drilling of a wellbore using at least two different ports for outputting two different types of drilling fluids, according to some embodiments.

FIG. 3 is a perspective view of a first example bottom hole assembly for downhole pulsed power drilling of a wellbore using at least two different ports for outputting two different types of drilling fluids, according to some embodiments. A bottom-hole assembly (BHA) 128 may include a pulsed power tool 330. The BHA 128 may also include the drill bit 114. The drill bit 114 may be integrated within the BHA 128 or may be a separate component that is coupled to BHA 128.

The pulsed power tool 330 may be coupled to provide pulsed electrical energy to the drill bit 114. The pulsed power tool 330 receives electrical power from a power source via a cable. For example, the pulsed power tool 330 may receive electrical power via the cable from a power source on the surface as described above with reference to FIG. 1, or from a power source located downhole such as a generator powered by a mud turbine. The pulsed power tool 330 may also receive electrical power via a combination of a power source on the surface and a power source located downhole. The pulsed power tool 330 converts the electrical power received from the power source into high-energy electrical pulses that are applied across an electrode 308 and a ground ring 350 of the drill bit 114.

Referring to FIG. 1 and FIG. 3, the first type of drilling fluid 192 may be conveyed from the surface of the wellbore 116 to the BHA 128 through the inner coil tubing 109. exit via a first port 309 (surrounding the electrode 308). In some implementations, the electrode 308 may include a flow port axially through it as a pathway for the first type of drilling fluid 192. For example, the electrode 308 may include a pathway that is essentially concentric within the stem and to the face of the electrode 308. Such a flow port axially through the electrode 308 may be alternative or in addition to the flow around the electrode 308 (as shown in FIG. 3). The second type of drilling fluid 190 may be conveyed from the surface of the wellbore 116 to the BHA 128 through the outer coil tubing 108 exit via one or more second ports 311.

Figure 4:
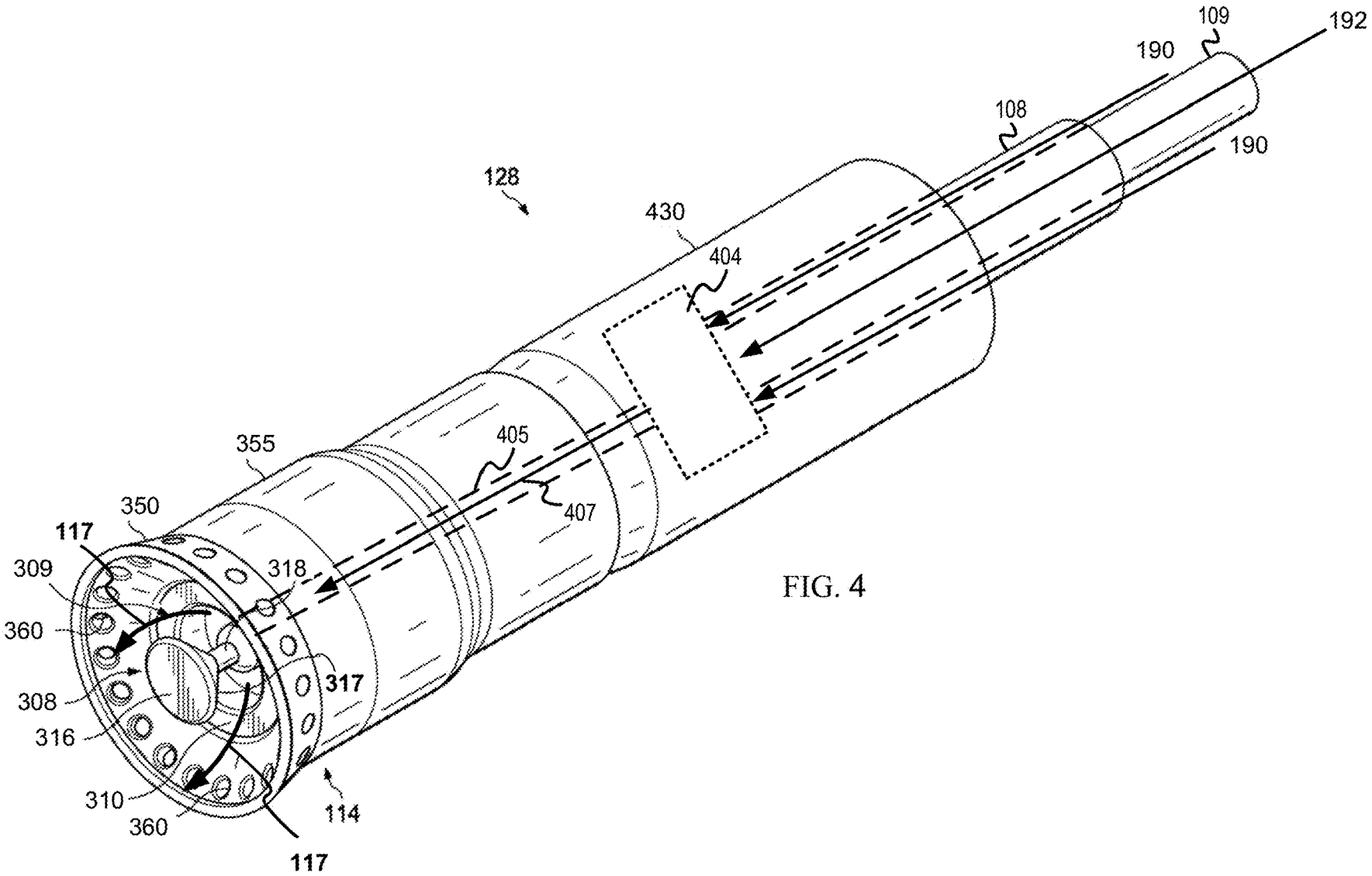
FIG. 4 is a perspective view of a second example of a bottom hole assembly for downhole pulsed power drilling of a wellbore using a same port at or near the face of the drill bit for outputting two different types of drilling fluids, according to some embodiments.

In some implementations, the first port 309 may also be used to output all or at least a portion of the second type of drilling fluid 190. In some implementations, one or more valves may be used to meter one or the other of the first type and second type of drilling fluids or both being output from the first port 309. An example of such a configuration of one or more valves is depicted in FIG. 4 (which is further described below). Such metering (and using the first port 309) may be employed to provide a dielectric fluid (the first type of drilling fluid 192) presence during the build and discharge of the arc and providing the water based fluid (the second type of drilling fluid 190) to clean the hole at other times. The duty cycle nature of the pulsed power process may support such alternating of the drilling fluids. For example, the actual electrical pulse comprises on the order of 1% of the time of each cycle and therefore most of the time output to the first port may include presence of the second type of drilling fluid.

Some implementations may be used for arcing at the face of the drill bit 114 in presence of predominantly the dielectric drilling fluid (the first type of drilling fluid 192) (even with the higher volumetric flow rate of the second type of drilling fluid 190). In some implementations, the second type of drilling fluid 190 circulating through the outer coil tubing 108 and into the wellbore annulus (or vice versa if in a reverse circulation) may be output via the one or more second ports 311 between an interior and an exterior of the BHA 128 (above a face of the drill bit 114). For example, the one or more second ports 311 may be positioned in a range of 1-2 inches (or less) above the face of the drill bit 114.

Such a position of the one or more second ports 311 may ensure the arc from the electrode 308 does not seek a short circuit through the second type of drilling fluid 190. The first type of drilling fluid 192, at a relatively smaller volumetric flow rate, may be the sole fluid present in the small volume surrounding the electrode 308 (and the ground ring 350) where the arc is launched and received. The flow rate of the first type of drilling fluid 192 would still be sufficient for the immediate clearing of cuttings from the bit face area, and to the fluid interface with the second type of drilling fluid 190. Also, a two port configuration (such as shown in FIG. 3) may or may not use valves for regulating the flow of the drilling fluids. For example, a two port configuration may not use valves such that there may be a continuous flow of both fluids to their respective ports. In other examples, valves may be used to regulate the flows of the two different drilling fluids. In some implementations, this regulating may be in accordance with the timing diagrams depicted in FIG. 7A-7C or 8A-8C (which are further described below).

In some implementations, at least one of an outer diameter of the ground structure (e.g., the ground ring 350) or a gage section of the drill bit 114 may be coated with a material that is electrically insulative. In some implementations, a tortuous path may be created between the face of the drill bit 114 and the annulus of the wellbore 116 to minimize contamination of the area around the face of the drill bit 114 by the second type of drilling fluid 190. In some implementations, a pressure gradient may be created from the face of the drill bit 114 and the annulus to minimize contamination of the area around the face of the drill bit 114 by the second type of drilling fluid 190. In some implementations, a rotor may be positioned between the first port 309 to output the first type of drilling fluid 192 and one or more second ports 311 to output the second type of drilling fluid 190. For example, a rotor may be positioned on the BHA between the face of the drill bit 114 and the one or more second ports 311. The rotor may rotate to limit the movement of the bulk drilling fluid downward toward the face of the drill bit 114.

While one electrode 308 is shown in FIG. 3, the drill bit 114 may include multiple electrodes 308. The drill bit 114 may include a solid insulator 310 surrounding the electrode 308 and one or more orifices (or port) (not expressly shown in FIG. 1 or 3) on the face of the drill bit 114 through which the first type of drilling fluid 192 exits the drill bit 114. Such orifices may be simple holes, or they may be nozzles or other shaped features. Additionally, the shape of the solid insulator 310 may be selected to enhance the flow of the first type of drilling fluid 192 around the components of the drill bit 114. An orifice for the first type of drilling fluid 192 may be through the body of the electrode 308 and preferably concentric with electrode 308. In embodiments with multiple electrodes 308, one or more of such electrodes may include orifices for drilling fluid 192.

The first type of drilling fluid 192 is typically circulated at a flow rate sufficient to remove fractured rock from the vicinity of the drill bit 114. In addition, the second type of drilling fluid 190 may be under sufficient pressure at a location in the wellbore 116, particularly a location near a hydrocarbon, gas, water, or other deposit, to prevent a blowout.

The drill bit 114 may include a bit body 355, an electrode 308, a ground ring 350, and a solid insulator 310. The electrode 308 may be placed approximately in the center of the drill bit 114. The distance between the electrode 308 and the ground ring 350 may be a minimum of approximately 0.4 inches and a maximum of approximately 4 inches. The distance between electrode 308 and ground ring 350 may be based on the parameters of the drilling operation. For example, if the distance between electrode 308 and ground ring 350 is too small, the first type of drilling fluid 192 may break down and the arc between the electrode 308 and the ground ring 350 may not pass through the rock. However, if the distance between the electrode 308 and the ground ring 350 is too large, the drilling bit 114 may not have adequate voltage to form an arc through the rock. For example, the distance between the electrode 308 and the ground ring 350 may be at least 0.4 inches, at least 1 inch, at least 1.5 inches, or at least 2 inches.

The distance between the electrode 308 and the ground ring 350 may be based on the diameter of the drill bit 114. The distance between the electrode 308 and the ground ring 350 may be generally symmetrical or may be asymmetrical such that the electric field surrounding the drill bit 114 has a symmetrical or asymmetrical shape. The distance between the electrode 308 and the ground ring 350 allows the first type of drilling fluid 192 to flow between the electrode 308 and the ground ring 350 to remove vaporization bubbles from the drilling area. If the drilling system 100 experiences vaporization bubbles in the first type of drilling fluid 192 near the drill bit 114, the vaporization bubbles may have deleterious effects. For instance, vaporization bubbles near the electrode 308 may impede formation of the arc in the rock. The first type of drilling fluid 192 may be circulated at a flow rate also sufficient to remove vaporization bubbles from the vicinity of the drill bit 114.

The electrode 308 may include three sections: a face 316, a body 317, and a stem 318. The face 316 is a distal portion of the electrode 308 in contact with the rock during a drilling operation. For example, the face 316 may engage with a portion of the wellbore 116 shown in FIG. 1. The body 317 couples the face 316 to the stem 318. The stem 318 couples the electrode 308 to the drill bit 114. The electrode 308 may have any suitable diameter based on the drilling operation. For example, the electrode 308 may have a diameter between approximately two and approximately ten inches. In some embodiments, the electrode 308 may be smaller than two inches in diameter. The diameter of the electrode 308 may be based on the diameter of the drill bit 114 and the distance between the electrode 308 and the ground ring 350, as described above.

The geometry of the electrode 308 affects the electric field surrounding the drill bit 114 during drilling. For example, the geometry of the electrode 308 may be designed to result in an enhanced electric field surrounding the electrode 308 so that the arcs initiate at the electrode 308 and terminate on the ground ring 350, or vice versa such that the arc initiates from the ground ring 350 and terminate on the electrode 308. The electric field surrounding the electrode 308 may be designed so that most of the arcs initiating between the electrode 308 and the ground ring 350 do so through a path or multitude of paths that results in more efficient rock removal, for example a path or paths through the rock. Similarly, the electric field surrounding the electrode 308 may be designed so as to minimize the arcs initiating between the electrode 308 and the ground ring 350 that do so through a path or multitude of paths that results in less efficient rock removal, for example path or paths short-cutting through the first type of drilling fluid 192 without penetrating the rock. For example, the face 316 of the electrode 308 may be engaged with a surface of the wellbore 116 and a distal portion of the ground ring 350 may also be engaged with the surface of the wellbore 116. The electric field may be designed such that the electric field is enhanced at a portion of the electrode 308 proximate to the face 316 and on a portion of the ground ring 350 proximate to the distal portion of the ground ring 350. An enhanced electric field in a region surrounding the drill bit 114 may result in an increased electric flux in that region. For example, the electric field $E_s$ in the vicinity of a specifically shaped conducting structure will be larger than the average macroscopic electrical field created by the applied voltage over the average spacing $E_{applied}$ by the field enhancement factor, y, defined by the equation below:

$$\gamma = \frac{E_s}{E_{applied}}$$

The geometry of the electrode 308 includes the profile of the face 316, the shape of the body 317, and contours of transitions between the face 316, the body 317, and the stem 318. For example, the face 316 may have a flat profile, a concave profile, or a convex profile. The profile may be based on the design of the electric field surrounding the drill bit 114. The body 317 may be generally conical shaped, cylindrical shaped, rectangular shaped, polyhedral shaped, tear drop shaped, rod shaped, or any other suitable shape. The transitions between the face 316 and the body 317 may be contoured to result in electric field conditions that are either favorable or unfavorable for arc initiation or termination. For example, the transition between the face 316 and the body 317 may have a sharp radius of curvature such that the electric field conditions are favorable for an arc to initiate and/or terminate at the transition between the face 316 and the body 317.

In contrast, the transition between the body 317 and the stem 318 may have a gentle radius of curvature such that the conditions are not favorable for arc initiation and/or termination at the transition between the body 317 and the stem 318. A radius of curvature of a transition is the radius of a circle of which the arc of the transition is a part. By way of example, a sharp radius of curvature may be a radius greater than 0.01 inches, and sometimes in the range of approximately 0.05 to approximately 0.15 inches, such as approximately 0.094 inches, and a gentle radius of curvature may be a radius in the range of approximately 0.15 to approximately 1.0 inches, such as approximately 0.25 inches, approximately 0.5 inches, approximately 0.75 inches, or approximately 1.0 inches. The ratio of the gentle radius of curvature to the sharp radius of curvature may be by approximately 2:1 or more, and may be up to 5:1, 10:1, or substantially greater than 10:1. The gentle radius may be determined based on the geometry of the surrounding structures on the drill bit 114 and the shape of the electric field for a given drilling operation. For example, the electric fields on the electrode 308 may be a function of the geometry of the ground ring 350 and the geometry and material of the insulator 310. For example, the radius of the edge of the electrode 308 and the shape of the electrode 308 may affect the interaction of the drill bit 114 with the rock. Additionally, the structure of the ground ring 350 may be adjusted to change the electric field distribution on the electrode 308. Further, the material used to form the insulator 310 and the configuration of the insulator 310 may be adjusted to change the electric field on the electrode 308. In some examples, the dielectric constant of the first type of drilling fluid 192 and the geometry of the rock fragments and the wellbore 116 during the drilling process may affect the instantaneous electric field distribution on the electrode 308.

The geometry of the drill bit 114, and specifically certain dimensions between the electrode 308 and the ground ring 350, may be designed to maximize the occurrence of arc paths between the electrode and ground ring which travel through the rock, and/or to minimize short-cut paths for arcs to travel between the electrode 308 and ground ring 350. The body 317, or the body 317 in combination with the stem 318, may be shaped to result in a first minimum distance between the electrode 308 and the ground ring 350, with a substantial portion of the electrode's conductive surface in the axial direction, perpendicular to the face 316, being at a greater distance from the ground ring 350. The first minimum distance may be a distance less than the average distance between the electrode 308 and the ground ring 350. The first minimum distance may result in a relative enhancement or concentration of the electric field at the perimeter of the face 316 versus the balance of the axial extent of the electrode 308, for example such that first minimum distance is at least approximately 15% less than the average distance between the electrode 308 and the ground ring 350, at least approximately 25% less than the average distance between the electrode 308 and the ground ring 350, or at least approximately 50% less than the average distance between the electrode 308 and the ground ring 350. A conical shaped ground ring as shown in FIG. 3 may achieve this criterion, as may a semi-sphere or certain other geometries. For example, in FIG. 3, the first minimum distance may be the distance between the perimeter of the face 316 and the ground ring 350 while the average distance between the electrode 308 and the ground ring 350 is calculated including the distance between the body 317 and the ground ring 350 and the stem 318 and the ground ring 350. The first minimum distance may be such that the electric field is enhanced or concentrated on a portion of the electrode 308 proximate to the face 316 and on a portion of the ground ring 350 proximate to the distal portion of the ground ring 350.

The ground ring 350 may function as an electrode and provide a location on the drill bit 114 where an arc may initiate and/or terminate. The ground ring 350 also provides one or more fluid flow ports 360 such that the first type of drilling fluid 192 flows through fluid flow ports 360 to carry fractured rock and vaporization bubbles away from the drilling area. Further, the ground ring 350 provides structural support for the drill bit 114 to support the downforce caused by the weight of the drilling components uphole from the drill bit 114. The drill bit 114 may additionally include an additional structural component (not expressly shown) that supports the downforce created by the weight of the drilling components uphole from the drill bit 114. For example, an insulative ring or studs may be located on the drill bit 114 to bear some or all of the weight of the drilling components and the weight of some or all of the drill string. As another example, a structural support structure, physically separated from but coupled to the ground ring electrode, may be used to support the weight of the drilling components.

In some implementations, a same port at or near the face of the drill bit may be used for outputting two different types of drilling fluids. For example, a valve system that comprises one or more valves may be used for regulating the flow of the two different drilling fluids to the same port. The valve system may be at least one of integral or distributed.

In some implementations, the valve system may comprise multiple two-way valves. For example, an input of a first valve of the one or more valves of the valve system may be configured to be fluidly coupled with a first conduit for receiving the first type of drilling fluid. An output of the first valve may be configured to be fluidly coupled to the first port. Also, for this example, an input of the second valve may be configured to be fluidly coupled with a second conduit for receiving the second type of drilling fluid. An output of the second valve may be configured to be fluidly coupled to the first port. In operation, the first valve may output the first type of drilling fluid to the first port at least while an arc is emitted from the at least one electrode and into a rock of the subsurface formation. Also, the second valve may output the second type of drilling fluid to the first port at least while an arc is not emitted from the at least one electrode and into the rock of the subsurface formation.

In some implementations, the valve system may comprise a single three-way valve. To illustrate, FIG. 4 is a perspective view of a second example of a bottom hole assembly for downhole pulsed power drilling of a wellbore using a same port at or near the face of the drill bit for outputting two different types of drilling fluids, according to some embodiments. In particular, FIG. 4 is a different example of the BHA 128 (as compared to the example of the BHA 128 of FIG. 3). In this example of FIG. 4, the BHA 128 includes a pulsed power tool 430 having one port (the first port 309) for outputting both the first type of drilling fluid 192 and the second type of drilling fluid 190. Accordingly, in this example, there are no second ports 311 above the first port 309.

Additionally, the pulsed power tool 430 includes a valve 404. The valve 404 may include a first input port to receive the first type of drilling fluid 192 from the inner coil tubing 109 and a second input port to receive the second type of drilling fluid 190 from the outer coil tubing 108. The valve 404 may also include an output port that is coupled to the first port 309 via a conduit 405. The output port may output either or some combination of the first type of drilling fluid 192 and the second type of drilling fluid 190 (see fluid 407).

In some implementations, the valve 404 may be used to meter one or the other of the first type and second type of drilling fluids or both being output from the first port 209. Such metering (and using this same port) may be employed to provide a dielectric fluid (the first type of drilling fluid 192) presence during the build and discharge of the arc and providing the water based fluid (the second type of drilling fluid 190) to clean the hole at other times. The duty cycle nature of the pulsed power process may support such alternating of the drilling fluids. For example, the actual electrical pulse may comprise on the order of 1% of the time of each cycle and therefore most of the time output to the first port may include presence of the second type of drilling fluid 190.

Similar to FIG. 3, the example of the BHA 128 of FIG. 4 may include the drill bit 114. The drill bit 114 may include the bit body 355, the electrode 308, the ground ring 350, and the solid insulator 310. The electrode 308 may be placed approximately in the center of the drill bit 114. The distance between the electrode 308 and the ground ring 350 may be a minimum of approximately 0.4 inches and a maximum of approximately 4 inches. The distance between electrode 308 and ground ring 350 may be based on the parameters of the drilling operation.

Similar to FIG. 3, the electrode 308 may include three sections: the face 316, the body 317, and the stem 318. The face 316 is a distal portion of the electrode 308 in contact with the rock during a drilling operation. For example, the face 316 may engage with a portion of the wellbore 116 shown in FIG. 1. The body 317 couples the face 316 to the stem 318. The stem 318 couples the electrode 308 to the drill bit 114. The electrode 308 may have any suitable diameter based on the drilling operation. For example, the electrode 308 may have a diameter between approximately two and approximately ten inches. In some embodiments, the electrode 308 may be smaller than two inches in diameter. The diameter of the electrode 308 may be based on the diameter of the drill bit 114 and the distance between the electrode 308 and the ground ring 350, as described above. The ground ring 350 may function as an electrode and provide a location on the drill bit 114 where an arc may initiate and/or terminate. The ground ring 350 also provides one or more fluid flow ports 360 such that the first type of drilling fluid 192 flows through fluid flow ports 360 to carry fractured rock and vaporization bubbles away from the drilling area. Further, the ground ring 350 provides structural support for the drill bit 114 to support the downforce caused by the weight of the drilling components uphole from the drill bit 114. The drill bit 114 may additionally include an additional structural component (not expressly shown) that supports the downforce created by the weight of the drilling components uphole from the drill bit 114. For example, an insulative ring or studs may be located on the drill bit 114 to bear some or all of the weight of the drilling components and the weight of some or all of the drill string. As another example, a structural support structure, physically separated from but coupled to the ground ring electrode, may be used to support the weight of the drilling components. In some implementations, there may be an alternating of fluids, wherein the valve may spend an extended period of time (e.g., seconds or more) with the first type of drilling fluid 192 before a flush with the second type of drilling fluid 190.

Examples of First Type of Drilling Fluid

Examples of the first type of drilling fluid 192 (also referred to below as a "pulsed power drilling fluid) are now described.

To limit discharge of the electric field through the first type of drilling fluid 192 and allow more electrical current to flow into the rock at the end of wellbore 116, an electrically insulating drilling fluid with a high dielectric constant and a high dielectric strength at a particular operating frequency may be used. An electrically insulating drilling fluid restricts the movement of electrical charges, and therefore, the flow of electrical current through the drilling fluid. A high dielectric constant and high dielectric strength decrease electrical discharge through the first type of drilling fluid 192. The dielectric constant of the downhole fluid indicates the ability of the drilling fluid to store electrical energy when exposed to an electric field, such as the potential created by the drill bit 114, while the dielectric strength of the downhole fluid indicates a voltage level to which first type of drilling fluid 192 may be exposed before experiencing electrical breakdown, or a loss of its electrically insulating properties.

The first type of drilling fluid 192 may be formulated to have:

i) at least a set dielectric constant, such as at least 6, at least 10, at least 12, or at least 13 (at 100 KHz frequency), ii) at least a set dielectric strength, such as at least 100 kV/cm, at least 150 kV/cm, or at least 330 kV/cm (at 10 microseconds rise time), and iii) less than a set electric conductivity, such as less than 10-4 mho/cm, or less than 10-5 mho/cm.

The first type of drilling fluid 192 may include a drilling base fluid and may include one or more additives. Generally, the drilling base fluid may be present in an amount sufficient to form a pumpable drilling fluid. By way of example, the drilling base fluid may be present in the first type of drilling fluid 192 in an amount in the range of from 20% to 99.99% by volume of the first type of drilling fluid 192.

One drilling base fluid may include a polar oil and an alkylene carbonate as well as a non-polar oil, water, glycerin, or any combinations thereof in an invert emulsion. The polar oil:alkylene carbonate ratio may be between 75:25 to 85:15, particularly 80:20 (v:v). The non-polar oil:polar oil and alkylene carbonate mixture ratio may be between 25:75 to 35:65, particularly 30:60 (v:v). The oil:water ratio may be between 40:60 and 99:1, between 50:50 and 90:10, or less than 75:25 (v:v). The glycerin:polar oil and alkylene carbonate mixture ratio may be between 5:95 and 15:85, particularly 10:90 (v:v).

Another electrocrushing drilling base fluid includes non-polar oil, water, and glycerin without both a polar oil and an alkylene carbonate or without any polar oil or alkylene carbonate. The non-polar oil:water ratio may be between 75:25 and 85:15, particularly 80:20 (v:v). The non-polar oil:glycerin ratio may be between 60:40 and 70:30, particularly 66:33 (v:v). The water:glycerin ratio may be between 25:75 and 35:65, particularly 30:60 (v:v).

Polar oil, if present, may include a combination of polar oils. Polar oils may include a vegetable oil, such as castor oil, an ester oil, such as a polyol ester or monoester oil, or any combination thereof. Polyol ester and monoester oils may provide greater hydrolytic stability, lower viscosity, or both as compared to vegetable oils.

A polar oil may include any ester of a carboxylic acid, such as a carboxylic acid with between 8 and 20 carbons, and 0, 1, or 2 moles of unsaturation. The carboxylic acid may be esterified using an alcohol, such as methanol, isopropanol, or 2-ethylhexanol.

A polar vegetable oil may include esters of vegetable oils such as esters of palm oil, palm kernal oil, rape seed oil, soybean oil, steric acid, oleic acid, and linoleic acid, and any combinations thereof.

A polyol ester oil may include a glycol ester oil, such as a neopentyl glycol diester.

A monoester oil may include hexanyl propanoate and isomers, hexanyl butyrate and isomers, hexanyl hexanoate and isomers, hexanyl octanoate and isomers, hexanyl decanoate and isomers, hexanyl laureate and isomers, hexanyl palmitate and isomers, hexanyl hexadecanoate and isomers, hexanyl stearate and isomers, octanyl propanoate and isomers, octanyl butyrate and isomers, octanyl hexanoate and isomers, octanyl octanoate and isomers, octanyl decanoate and isomers, octanyl laureate and isomers, octanyl palmitate and isomers, octanyl hexadecanoate and isomers, octanyl stearate and isomers, decanyl propanoate and isomers, decanyl butyrate and isomers, decanyl hexanoate and isomers, decanyl octanoate and isomers, decanyl decanoate and isomers, decanyl laureate and isomers, decanyl palmitate and isomers, decanyl hexadecanoate and isomers, decanyl stearate and isomers, dodecanyl propanoate and isomers, dodecanyl butyrate and isomers, dodecanyl hexanoate and isomers, dodecanyl octanoate and isomers, dodecanyl decanoate and isomers, dodecanyl laureate and isomers, dodecanyl palmitate and isomers, dodecanyl hexadecanoate and isomers, dodecanyl stearate and isomers, tetradecanyl propanoate and isomers, tetradecanyl butyrate and isomers, tetradecanyl hexanoate and isomers, tetradecanyl octanoate and isomers, tetradecanyl decanoate and isomers, tetradecanyl laureate and isomers, tetradecanyl palmitate and isomers, tetradecanyl hexadecanoate and isomers, tetradecanyl stearate and isomers, hexadecanyl propanoate and isomers, hexadecanyl butyrate and isomers, hexadecanyl hexanoate and isomers, hexadecanyl octanoate and isomers, hexadecanyl decanoate and isomers, hexadecanyl laureate and isomers, hexadecanyl palmitate and isomers, hexadecanyl hexadecanoate and isomers, hexadecanyl stearate and isomers, octadecanyl propanoate and isomers, octadecanyl butyrate and isomers, octadecanyl hexanoate and isomers, octadecanyl octanoate and isomers, octadecanyl decanoate and isomers, octadecanyl laureate and isomers, octadecanyl palmitate and isomers, octadecanyl hexadecanoate and isomers, octadecanyl stearate and isomers, icosanyl propanoate and isomers, icosanyl butyrate and isomers, icosanyl hexanoate and isomers, icosanyl octanoate and isomers, icosanyl decanoate and isomers, icosanyl laureate and isomers, icosanyl palmitate and isomers, icosanyl hexadecanoate and isomers, icosanyl stearate and isomers, docosanyl propanoate and isomers, docosanyl butyrate and isomers, docosanyl hexanoate and isomers, docosanyl octanoate and isomers, docosanyl decanoate and isomers, docosanyl laureate and isomers, docosanyl palmitate and isomers, docosanyl hexadecanoate and isomers, docosanyl stearate, and any combinations thereof.

Specific suitable non-polar oils include PETROFREE® (Halliburton, Texas, US), which is an ester of 2-ethylhexanol reacted with palm kernel fatty acid, and PETROFREE LV® (Halliburton, Texas, US), which is an ester of 2-ethylhexanol reacted with C6 to C10 fatty acids.

Non-polar oils typically have a high dielectric strength and a low electric conductivity, making them suitable as the insulator in drilling base fluids. However, non-polar oils having a low dielectric constant, may be included with other components with a higher dielectric constant in a drilling base fluid. A non-polar oil suitable for use in a drilling base fluid of the present disclosure includes combinations of non-polar oils. Suitable non-polar oils include mineral oils, diesel oils or fuels, paraffin-based oils, oils containing branched and linear aliphatic hydrocarbons having between 8 and 26 carbon atoms and a boiling point in the range of 120° C. to 380° C., oils containing hydrocarbons having between 10 and 16 carbon atoms and a viscosity of 1.5 to 2 cSt at 40° C. Any of the non-polar oils or combinations thereof may have a viscosity of less than 4 cSt at 40° C.

Combinations of polar oils and non-polar oils may also be used. The polar oil, non-polar oil, or combination thereof may have a viscosity of less than 4 cSt at 40° C.

The drilling base fluid may also contain water. Water has a low viscosity and a high dielectric strength, but it also has a high electric conductivity, thus potentially limiting its proportional volume in the drilling fluid or base fluid. The electric conductivity of water further increases if salts are dissolved in the water, a frequent occurrence during drilling.

Water also has a highly temperature-variable dielectric constant that decreases with temperature and thus which may also limit water's proportional volume in the drilling fluid or base fluid because the drilling fluid typically experiences high temperatures in the vicinity of the drill bit for the pulsed power operations.

Polar oils tend to have dielectric constants or dielectric strengths that are too low for pulsed power drilling. As a result, an alkylene carbonate may be added to the drilling fluid or base fluid, particularly if it contains a polar oil, to the improve these properties because alkylene carbonates have a high dielectric constant and moderate dielectric strength. However, the amount of alkylene carbonate in the drilling base oil may be limited by their electric conductivity. Butylene carbonate, propylene carbonate, glycerine carbonate, and combinations thereof may be used.

The drilling fluid or base fluid may further include glycerin. Glycerin has a high dielectric constant and low electric conductivity, but also low dielectric strength, thus potentially limiting its proportional volume in the drilling fluid or base fluid.

Glycerin, water, and non-polar oil may be mixed in any order. However, drilling base fluids containing a mixture of polar oil and alkylene carbonate along with glycerin, water, non-polar oil, or any combination thereof may exhibit different electrical properties depending on the order and volumes in which components are mixed. These drilling base fluids may be formed by first mixing the polar oil and alkylene carbonate, then adding the glycerin, water, non-polar oil, or any combinations thereof. If a combination of any of glycerin, water, and non-polar oil is added, the combination may be added as a mixture or sequentially. In particular, a combination of non-polar oil, water, and glycerin may be added in that order.

One or more electrical additives may change one or more electrical properties of the drilling base fluid. For instance, an electrical additive may change a dielectric property of the drilling base fluid. Such additives may include mica in any of its various forms such as muscovite, phlogopite, leidolite, fluorophlogopite, glass-bonded mica, and biotite, polytetrafluoroethylene, other chemical variants of tetrafluoroethylene, glass or a composition of glass including fused silica and alkali-silicate, polystyrene, polyethylene, diamond, lead zirconate titanate (PZT), sodium chloride crystalline, potassium bromide crystalline, silicone oil, benzene, and any combinations thereof. The electrical additive may be present in the drilling fluid in an amount sufficient for a particular drilling system, formation, or combination thereof. The type of electrical additive or combination of electrical additives in a drilling fluid may also be based at least partially upon a particular drilling system, formation, or combination thereof.

The pulsed power drilling fluid may further include additives used in conventional drilling fluids. These additives may provide properties to the pulsed power drilling fluid similar to the properties they provide to conventional drilling fluids. However, some additives used in conventional drilling fluids may not be suitable for the pulsed power drilling fluid due to their effects on dielectric constant, dielectric strength, or electric conductivity, or because they are not compatible with the drill bit.

Additives may include a lost circulation prevention material, such as a bridging material or a fluid loss control agent, a rheology modifier, such as a viscosifier or a thinner, a weighting agent, a solids wetting agent, an acid or $H_2S$ scavenger, a lubricant other additives, and any combinations thereof.

Lost circulation materials are capable of reducing the amount of whole drilling fluid that is lost to fractures and natural caverns during the drilling process. Lost circulation materials include mica, fibers, and hard organic materials, such as nutshells. The lost circulation material may be present in the first type of drilling fluid 192 in an amount sufficient for a particular drilling system, formation, or combination thereof. The type of lost circulation material or combination of lost circulation materials in the first type of drilling fluid 192 may also be based at least partially upon a particular drilling system, formation, or combination thereof.

Lost circulation materials include bridging materials, which bridge across pores and fractures in the formation and help prevent loss of drilling fluid into the formation. Bridging materials may include but are not limited to calcium carbonate, salt suspensions, resins, BARACARB® (Halliburton, Texas, US) size-ground marble, N-SEAL™ (Halliburton, Tex., US) extrusion spun mineral fiber or similar materials.

Fluid loss control agents, which help control loss of the liquid portion of the drilling fluid into the formation, may also be used in the first type of drilling fluid 192. Fluid loss control agents include clays and polymers, such as synthetic polymers or natural polymers, such as lignitic polymers.

Rheology modifiers may change the flow properties of the first type of drilling fluid 192. Rheology modifiers may, for instance, change the shear properties or viscosity of the drilling fluid. The rheology modifier may be present in the first type of drilling fluid 192 in an amount sufficient for a particular drilling system, formation, or combination thereof. The type of rheology modifier or combination of rheology modifiers in the first type of drilling fluid 192 may also be based at least partially upon a particular drilling system, formation, or combination thereof.

Thinners are a type of rheology modifier that decreases the viscosity of a drilling fluid. In drilling fluids that experience flocculation, such as drilling fluids containing some clays, thinners may also be deflocculants. Pulsed power drilling may benefit from a low viscosity drilling fluid, such that thinners may be a particularly useful additive.

Viscosifiers increase the viscosity of a drilling fluid. A viscosifier may be used in the drilling fluid to impart a sufficient carrying capacity or thixoropy or both to the drilling fluid, enabling the drilling fluid to transport and prevent settling of fractured rock or weighting materials, or both. Suitable viscosifiers include organophilic clays such as GELTONE® II viscosifier (Halliburton, Texas, US), polymeric viscosifiers, such as BARARESIN® VIS viscosifier (Halliburton, Texas, US), long chain fatty acids, dimer/trimer/tetramer fatty acids (RM-63™ viscosifier, Halliburton, Texas, US), and any combinations thereof.

The first type of drilling fluid 192 may have a viscosity at surface temperature and pressure sufficient to allow it to suspend any particles additives, such as barite or a dielectric modifier, while still allowing it to be pumped downhole. In the wellbore, the drilling fluid may maintain a viscosity sufficient to allow it to suspend any particle additives, while still allowing it to circulate through and out of the wellbore. The first type of drilling fluid 192 may further maintain a viscosity upon return to surface pressure or temperature sufficient to allow it to exit the wellbore. The first type of drilling fluid 192 may also further maintain its viscosity to allow it to continue to suspend any particles additives, such as barite, until it reaches a holding tank, through any cleaning or testing process, or until it is returned to a wellbore, as applicable.

Emulsifiers help create a mixture of two immiscible liquids, such as an oil-based liquid and an aqueous liquid. Suitable emulsifiers include polyaminated fatty acids, Tall Oil Fatty Acids, Oxidized and modified Tall oil fatty acids, Rosins, Resins and synthetic emulsifiers. The first type of drilling fluid 192 may be an invert emulsion and thus may particularly benefit from an emulsifier. The emulsifier may be present in the first type of drilling fluid 192 in an amount sufficient for a particular drilling system, formation, or combination thereof. The type of emulsifier or combination of emulsifier in the first type of drilling fluid 192 may also be based at least partially upon the immiscible components of the first type of drilling fluid 192, a particular drilling system, formation, or combination thereof.

Weighting agents increase the density of a pulsed power drilling fluid without being dissolved in it. Suitable weighting agents include barite, hematite, ilmenite, manganese tetraoxide, calcium carbonate coated hematite, calcium carbonate coated ilmenite, and any combinations thereof. The weighting agent may be present in the pulsed power drilling fluid in an amount sufficient for a particular drilling system, formation, or combination thereof. The type of weighting agent or combination of weighting agents in the pulsed power drilling fluid may also be based at least partially upon a particular drilling system, formation, or combination thereof. Typically, for pulsed power drilling, the amount of weighing agent present is sufficient to maintain a pulsed power drilling fluid density between 8 lb/gallon and 21 lb/gallon.

Other additives may include corrosion inhibitors, defoamers, shale stabilizers, lubricants, wetting agents, dispersing agents, shale inhibitors, pH-control agents, filtration-control agents, alkalinity sources such as lime and calcium hydroxide, salts, foamers, viscosifiesr, thinners, deflocculents, or any combinations thereof. The other additives may be present the pulsed power drilling fluid in an amount sufficient for a particular drilling system, formation, or combination thereof. The type of other additives or combination of other additives in the pulsed power drilling fluid may also be based at least partially upon a particular drilling system, formation, or combination thereof.

Some additives, such as lignitic fluid loss control agents and polyaminated fatty acid emulsifiers, may have synergistic effects.

In addition to conventional uses for additives, some additives may have a further effect or may be added solely for the effect of rendering the pulsed power drilling fluid or the drilling system more resistant to cavitation caused by pulsed power drilling or by better mitigating cavitation effect as compared to conventional drilling fluids or pulsed power drilling fluids without the additive.

The following examples are provided to further illustrate example implementations.

Example 1: Pulsed Power Drilling Fluid with Base Fluid Containing Polar Oil, Alkylene Carbonate, Non-Polar Oil, Water, and Glycerin The following components were mixed at high shear:

- Polyol ester—220 g (253.1 ml) LEXOLUBE® 21-214 (Innolex, Pennsylvania, US) (neopentyl glycol diester, 6 cSt at 40° C.)
- Alkylene carbonate—72.4 g (63.3 ml) butylene carbonate
- Organophilic clay—15 g Geltone® II (Halliburton, Texas, US)
- Fluid loss control agent—12 g Duratone® HT (Halliburton, Texas, US) (modified lignitic product)
- Weighting agent—150 g barite
- Emulsifier—0.45 g (5 ml) LE Supermul® (Halliburton, Texas, US) (polyaminated fatty acid).

The mixture had a dielectric constant of 14.8 at 100 KHz.

160 ml of this mixture mixed with 90 ml of Saraline 185V® (Shell Oil, Texas, US) (paraffin-based oil). The dielectric constant of the resulting mixture was 7.7.

10 ml of tap water and an additional 5 ml of LE Supermul® were then added to the mixture (10 ml of LE Supermul® could alternatively have been added to the original mixture). The resulting mixture had a dielectric constant to 10.0.

Finally, 30 ml of glycerin was added to the mixture. The resulting mixture had a dielectric constant of 13.2.

Thus, a pulsed power drilling fluid containing only polar oil and alkylene carbonate in its base fluid has a dielectric constant of 14.6, but non-polar oil, water, and glycerin could be added to produce a pulsed power drilling base fluid with a dielectric constant of 13.2, which is nearly as high. However, the cost per unit volume of the polar oil/alkylene carbonate/non-polar oil/water/glycerin base fluid is much less than that of the polar oil/alkylene carbonate base fluid.

Example 2: Pulsed Power Drilling Fluid with Base Fluid Containing Non-Polar Oil, Water, and Glycerin The following components were mixed at high shear:
Non-polar oil—139.1 g (180.9 ml) Saraline 185V®
Glycerin—69.7 g (32.6 ml)
Water—32.6 g (32.6 mL)
Lime—1.7 (g)
Organophilic clay—7 g Geltone® ||
Weighting agent—100 g barite
Emulsifier—9 g (10 ml) LE Supermul®
Simulated drilling solids—calcium carbonate, 50 μm particles—16.7 g
The resulting drilling base fluid had a dielectric constant of 6.6.

Example 3: Effect of Mixing Order on Pulsed Power Drilling Fluid with Base Fluid Containing Polar Oil, Alkylene Carbonate, Non-Polar Oil, Water, and Glycerin 40 ml of a monoester polar oil and 10 ml of butylene carbonate were added to 200 ml of the pulsed power drilling fluid of Example 2 and mixed at high shear. The resulting mixture had a dielectric constant of 7.0. This is very low compared to the dielectric constant of 13.2 obtained for a similar mixture in Example 1. The primary difference between the drilling fluid of Example 3 and that of Example 1 is the order of addition of components.

Example 4—Methods of Measuring Dielectric Constant and Electric Conductivity of a Pulsed Power Drilling Fluid The dielectric constant and electric conductivity of a pulsed drilling fluid, such as one disclosed herein, may be measured using a network analyzer or inductance, capacitance and resistance (LCR) meter equipped with a particular fixture, such as a liquid test fixture, to allow the measurement. Suitable measurement equipment includes that produced by Agilent (Santa Clara, Calif.) and Keysight (Santa Rosa, Calif.), particularly the Keysight 16452A Liquid Text Fixture and the Agilent E4991B Impedance Analyzer. Such equipment may be used in accordance with manufacturer instructions.

One of ordinary skill in the art may determine how to determine the frequency dependent dielectric constant and the electric conductivity of a pulsed power drilling fluid using the above-identified or similar equipment by applying the following principles, typically as implemented in a programmed computer receiving data from equipment.

The frequency dependent complex dielectric constant of a fluid may be determined by the following equation, which includes its real and imaginary parts:

$$\varepsilon(\omega) = \varepsilon_r'(\omega) + j\varepsilon_r''(\omega) = \varepsilon_r(\omega)\varepsilon_0 + j\frac{\sigma(\omega)}{\omega}$$

where:
$\varepsilon(\omega)$ is the frequency dependent complex dielectric constant
$\varepsilon r'(\omega)$ is the real part of the dielectric constant
$\varepsilon r''(\omega)$ is the imaginary part of the dielectric constant and $j=\sqrt{-1}$.
In addition, $$\varepsilon_r' = \varepsilon_r(\omega)\varepsilon_0$$

so that $$\varepsilon_r(\omega) = \frac{\varepsilon_r'(\omega)}{\varepsilon_0}$$

where:
$\varepsilon r(\omega)$ is the frequency dependent dielectric constant of the fluid and $\varepsilon 0$ is the permittivity of free space=8.85418782×10-12 Farads/Meter.
Additionally, $$\varepsilon_r''(\omega) = \frac{\sigma(\omega)}{\omega}$$

and therefore, $$\sigma(\omega) = \omega\varepsilon_r''(\omega)$$

Where $\sigma(\omega)$ is the frequency dependent electric conductivity of the fluid.

Example 5—Methods of Measuring Dielectric Strength of a Pulsed Power Drilling Fluid Equipment suitable to measure the dielectric strength of a pulsed power drilling fluid over a given rise time is generally not commercially available, but it may be constructed by attaching an adjustable voltage supply to electrodes immersed in the fluid and otherwise electrically insulated from one another such that an electric field (E) may be created between the electrodes using the adjustable voltage supply when it applies a voltage (V) across the electrodes. The electrodes may be any shape, such as spheres or plates. The electrodes are separated by a distance D. An ammeter is located in the circuit between the adjustable voltage supply and the negative electrode. The adjustable voltage supply may be used to provide high voltage pulses with an adjustable peak voltage and rise time.

$\vec{E}$ is determined using the following equation:

$$\vec{E} = \frac{V}{D}$$

$\vec{E}$ is a vector quantity and the direction of the electric field goes from the positive electrode toward the negative one. One may alter the electric field by adjusting either V or D. For a given rise time, for a series of voltage pulses across the electrodes and through the pulsed power drilling fluid under test, the peak electric field (E) for each pulse is increased until conduction current is observed in the ammeter. Conduction current indicates electrical breakdown of the liquid. For a given rise time, the electric field the pulsed power drilling fluid can support without breakdown (and hence measurement of a current by ammeter) is its dielectric strength for that rise time. By varying the rise time and electric field and noting the electric field/rise time combinations where breakdown occurs, one may determine the dielectric strength of the pulsed power drilling fluid as a function of rise time.

Example Multi-Fluid/Multi-Port Operations

Figure 5:
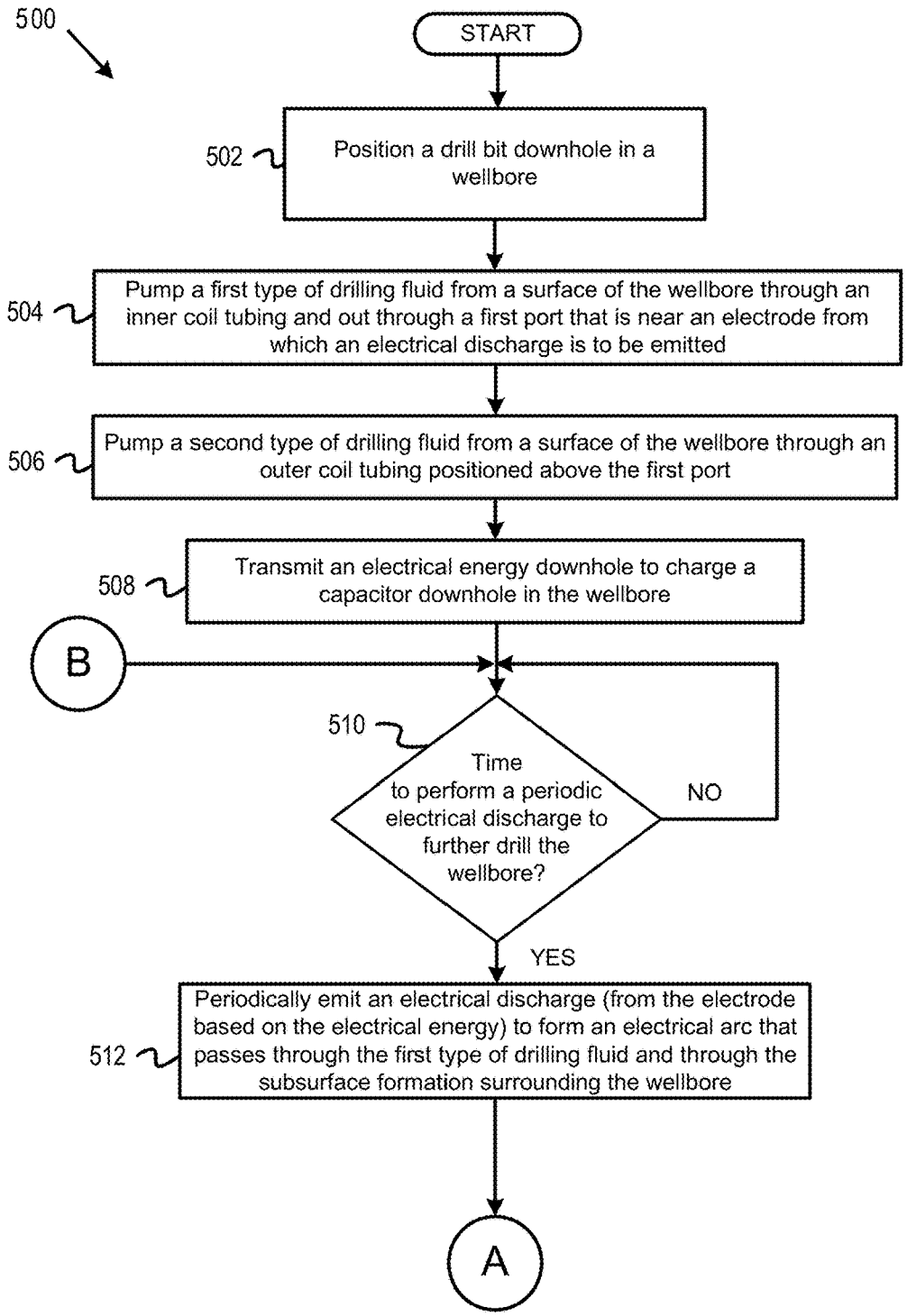
FIGS. 5-6 is a flowchart of first example operations for drilling a wellbore using at least two different ports for outputting two different types of drilling fluids, according to some embodiments.
Figure 6:
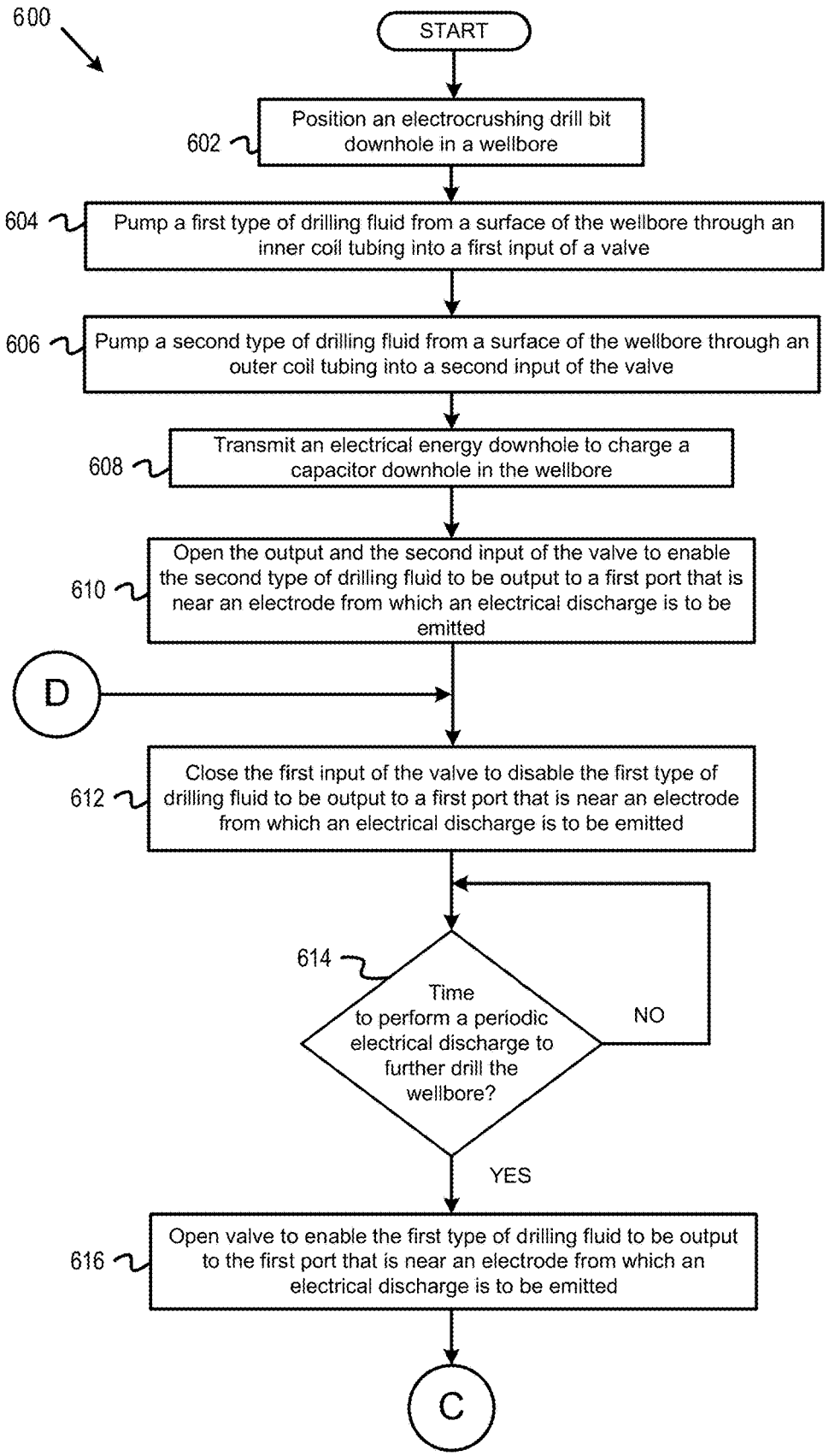

Example operations for pulsed power drilling with multiple selective drilling fluids are now described. FIGS. 5-6 is a flowchart of first example operations for drilling a wellbore using at least two different ports for outputting two different types of drilling fluids, according to some embodiments. Operations of flowcharts 500-600 of FIGS. 5-6 can be performed by software, firmware, hardware, or a combination thereof. In some implementations, one or more of the operations may be initiated or performed with a human operator's involvement or may be partially or fully automated. Operations of the flowcharts 500-600 continue between each other through transition points A-B. Operations of the flowcharts 500-600 are described in reference to FIGS. 1 and 3. However, other systems and components can be used to perform the operations now described. The operations of the flowchart 500 start at block 502.

At block 502, a drill bit is positioned downhole in a wellbore. For example, with reference to FIG. 1, the drill bit 114 may be positioned downhole in the wellbore 116.

At block 504, a first type of drilling fluid is pumped from a surface of the wellbore through an inner coil tubing and out through a first port that is near an electrode from which an electrical discharge is to be emitted. For example, with reference to FIG. 1, a controller may control the pump 124 to start the pump 124 pumping the first type of drilling fluid 192 down into the wellbore 116 via the inner coil tubing 109.

At block 506, a second type of drilling fluid is pumped from a surface of the wellbore through an outer coil tubing positioned above the first port. For example, with reference to FIG. 1, a controller may control the pump 124 to cause the pump 124 to start pumping the second type of drilling fluid 190 down into the wellbore 116 via the outer coil tubing 108.

At block 508, an electrical energy is transmitted downhole to charge a capacitor downhole in the wellbore. For example, with reference to FIG. 1, a controller may control the generator 140 to start the generator 140 generating electrical power that is then provided to the power conditioning unit 142 that transmits the electrical energy down the wellbore 116 via the surface cable 143 and a subsurface cable.

At block 510, a determination is made of whether it is time to perform a periodic electrical discharge to further drill the wellbore. For example, with reference to FIG. 3, a pulse of electrical discharge may be emitted periodically from the electrode 308 and into the subsurface formation. The timing of emission may vary depending on one or more factors-such as whether a capacitor in the BHA 128 is fully charged, whether the drill bit 114 is in contact with or near the bottom of the wellbore 116, etc. In some implementations, these pulses and corresponding arcs may occur between 50 and 500 times per second (having a rise and discharge time between 0.1 and 100 microseconds, or preferably between 10 to 20 microseconds for each arc). In some implementations, this operation to determine whether it is time to perform a periodic electrical discharge may be performed by a circuit that is tuned to perform this electrical discharge in a periodic manner or that fires/emits based upon analog levels versus threshold, etc. If it is not time to perform a periodic electrical discharge to further drill the wellbore, operations of the flowchart 500 remain at block 510 to make this determination. Otherwise, operations of the flowchart 500 continue at block 512.

At block 512, an electrical discharge is periodically emitted (from the electrode based on the electrical energy) to form an electrical arc that passes through the first type of drilling fluid and through the subsurface formation surrounding the wellbore. For example, with reference to FIG. 3, the electrode 308 may emit a pulse of electrical discharge (along with a corresponding arc) through the first type of drilling fluid 192 and into the subsurface formation surrounding the wellbore 116. Operations of the flowchart 500 continue a transition point A, which continues at transition point A of the flowchart 600. From transition point A of the flowchart 600, operations continue at block 602.

At block 602, fractured rock (caused by the electrical arc) is removed using the first type of drilling fluid and the second type of drilling fluid. For example, with reference to FIG. 1, the drilling fluid 122 circulating back to the surface via an annulus 126 formed between the outer coil tubing 108 and the sidewalls of the wellbore 116 may remove the fractured rock. The drilling fluid 122 may be a combination of the first type of drilling fluid 192 and the second type of drilling fluid 190.

At block 604, a determination is made of whether drilling is complete. For example, with reference to FIG. 1, a controller at the surface of the wellbore 116 may be configured to stop the current drilling operation based on user input, current depth of the wellbore 116, current duration of the current drilling operation, etc. If drilling is not complete, operations of the flowchart 600 continue at transition point B, which continues at transition point B at the flowchart 500 at FIG. 5 (which continues at block 510 where a determination is made of whether it is time to perform a periodic electrical discharge to further drill the wellbore). If drilling is complete, operations of the flowchart 600 continue at block 606.

At block 606, pumping the first type and second type of drilling fluids is stopped. For example, with reference to FIG. 1, a controller may control the pump 124 to stop the pump 124 from pumping the first type of drilling fluid 192 and the second type of drilling fluid 190 down into the wellbore 116 via the inner coil tubing 109 and the outer coil tubing 108, respectively.

At block 608, transmission of an electrical energy downhole to charge a capacitor downhole in the wellbore is stopped. For example, with reference to FIG. 1, a controller may control the generator 140 to stop the generator 140 from generating electrical power that was being provided to the power conditioning unit 142 that transmits the electrical energy down the wellbore 116 via the surface cable 143 and a subsurface cable. Operations of the flowchart 600 are complete.

In some implementations, timing between the current level of electrical of discharge being output from the drill bit for the pulsed power drilling and the flow rates of the first type of drilling fluid and the second type of drilling fluid from the two different ports may vary. Two such example timings are now described.

Figures 7A, 7B, 7C:
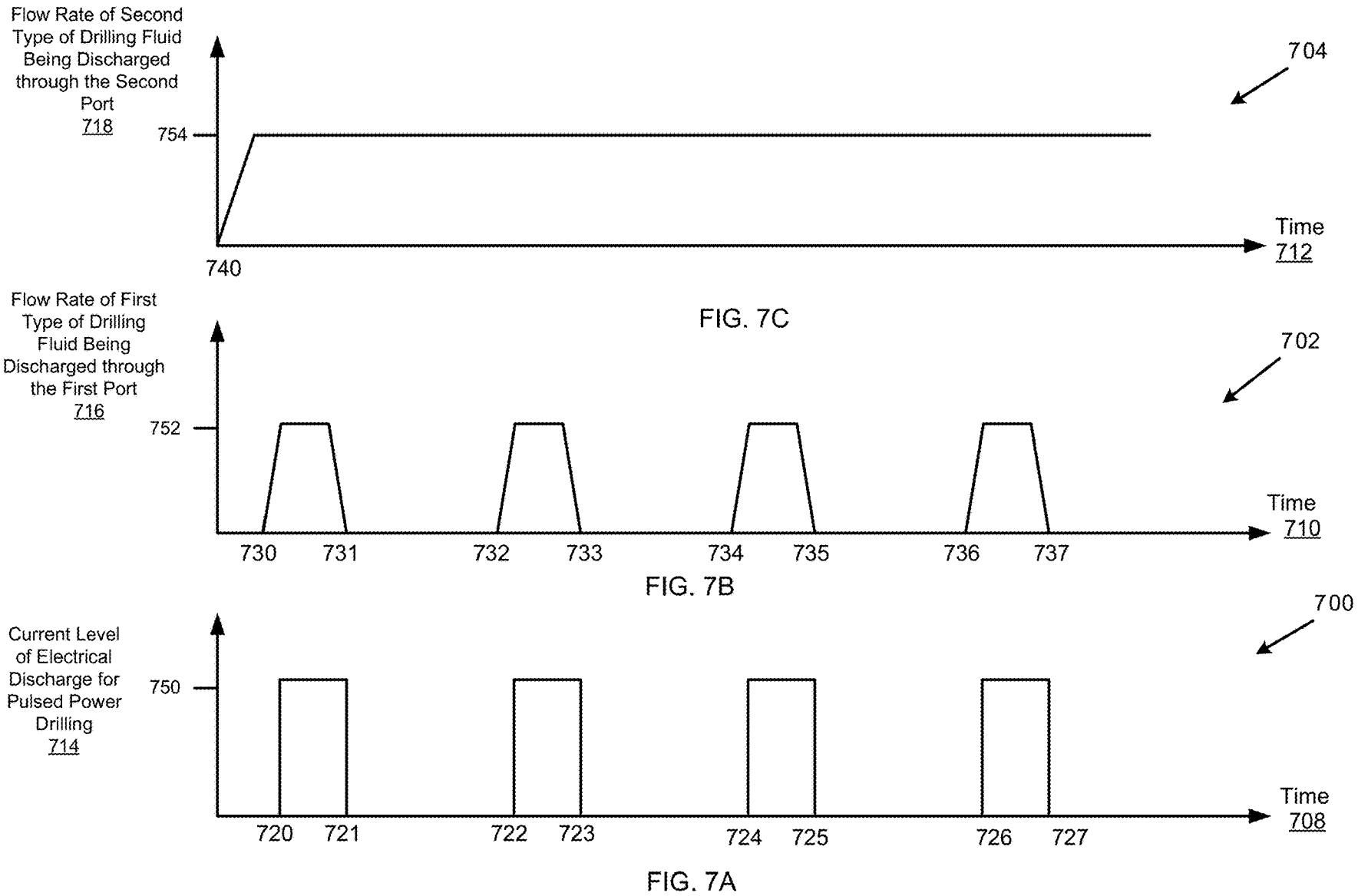
FIGS. 7A-7C are graphs illustrating a first example, over time, the periodic electrical discharges, the flow rate of the first type of drilling fluid through the first port, and the flow rate of the second type of drilling fluid through the second port, respectively, according to some embodiments.

FIGS. 7A-7C are graphs illustrating a first example, over time, the periodic electrical discharges, the flow rate of the first type of drilling fluid through the first port, and the flow rate of the second type of drilling fluid through the second port, respectively, according to some embodiments. FIGS. 7A-7C include graphs 700, 702, and 704, respectively. Each of the graphs 700-704 includes an x-axis 708-712, respectively, that is time. The graph 700 includes a y-axis 714 that is the current level of electrical discharge being output by the drill bit for pulsed power drilling. The graph 702 includes a y-axis 716 that is the flow rate of the first type of drilling fluid being discharged through the first port (at or near the drill bit). The graph 704 includes a y-axis 718 that is the flow rate of the second type of drilling fluid being discharged through the second port (uphole from the first port).

In this example, as shown in the graph 700 of FIG. 7A, there are periodic current discharges at substantially same current level (see 750). A first discharge starts at a time point 720 and ends at a time point 721. A second discharge starts at a time point 722 and ends at a time point 723. A third discharge starts at a time point 724 and ends at a time point 725. A fourth discharge starts at a time point 726 and ends at a time point 727. These periodic discharges may continue as part of the pulsed power drilling of the wellbore.

In this example, as shown in the graph 702 of FIG. 7B, the first type of drilling fluid may be periodically output at substantially the same flow rate from the first port to coincide with the start of each periodic current discharge. A time point 730 is a starting point for a first periodic output of the first type of drilling fluid through the first port (at or near the drill bit). In this example, the time point 730 is before but close to the time point 720 so that the flow rate of the first type of drilling fluid is at or near the maximum flowrate 752 when the electrical discharge begins at the time point 720. A time point 731 is the time at which the first type of drilling fluid stops flowing out from the first port. In this example, the flow rate of the first type of drilling fluid starts reducing at a time point that is equal to or substantially equal to the time point 721.

A time point 732 is a starting point for a second periodic output of the first type of drilling fluid through the first port (at or near the drill bit). In this example, the time point 732 is before but close to the time point 722 so that the flow rate of the first type of drilling fluid is at or near the maximum flowrate 752 when the electrical discharge begins at the time point 722. A time point 733 is the time at which the first type of drilling fluid stops flowing out from the first port. In this example, the flow rate of the first type of drilling fluid starts reducing at a time point that is equal to or substantially equal to the time point 723.

A time point 734 is a starting point for a third periodic output of the first type of drilling fluid through the first port (at or near the drill bit). In this example, the time point 734 is before but close to the time point 724 so that the flow rate of the first type of drilling fluid is at or near the maximum flowrate 752 when the electrical discharge begins at the time point 724. A time point 735 is the time at which the first type of drilling fluid stops flowing out from the first port. In this example, the flow rate of the first type of drilling fluid starts reducing at a time point that is equal to or substantially equal to the time point 725.

A time point 736 is a starting point for a fourth periodic output of the first type of drilling fluid through the first port (at or near the drill bit). In this example, the time point 736 is before but close to the time point 726 so that the flow rate of the first type of drilling fluid is at or near the maximum flowrate 752 when the electrical discharge begins at the time point 726. A time point 737 is the time at which the first type of drilling fluid stops flowing out from the first port. In this example, the flow rate of the first type of drilling fluid starts reducing at a time point that is equal to or substantially equal to the time point 727.

In this example, as shown in the graph 704 of FIG. 7C, the second type of drilling fluid may be output at a constant or substantially constant flow rate (see 754) during the time of the pulsed power drilling. In this example, a time point 740 is the start of the output of the flow of the second type of drilling fluid through the second port.

Figures 8A, 8B, 8C:
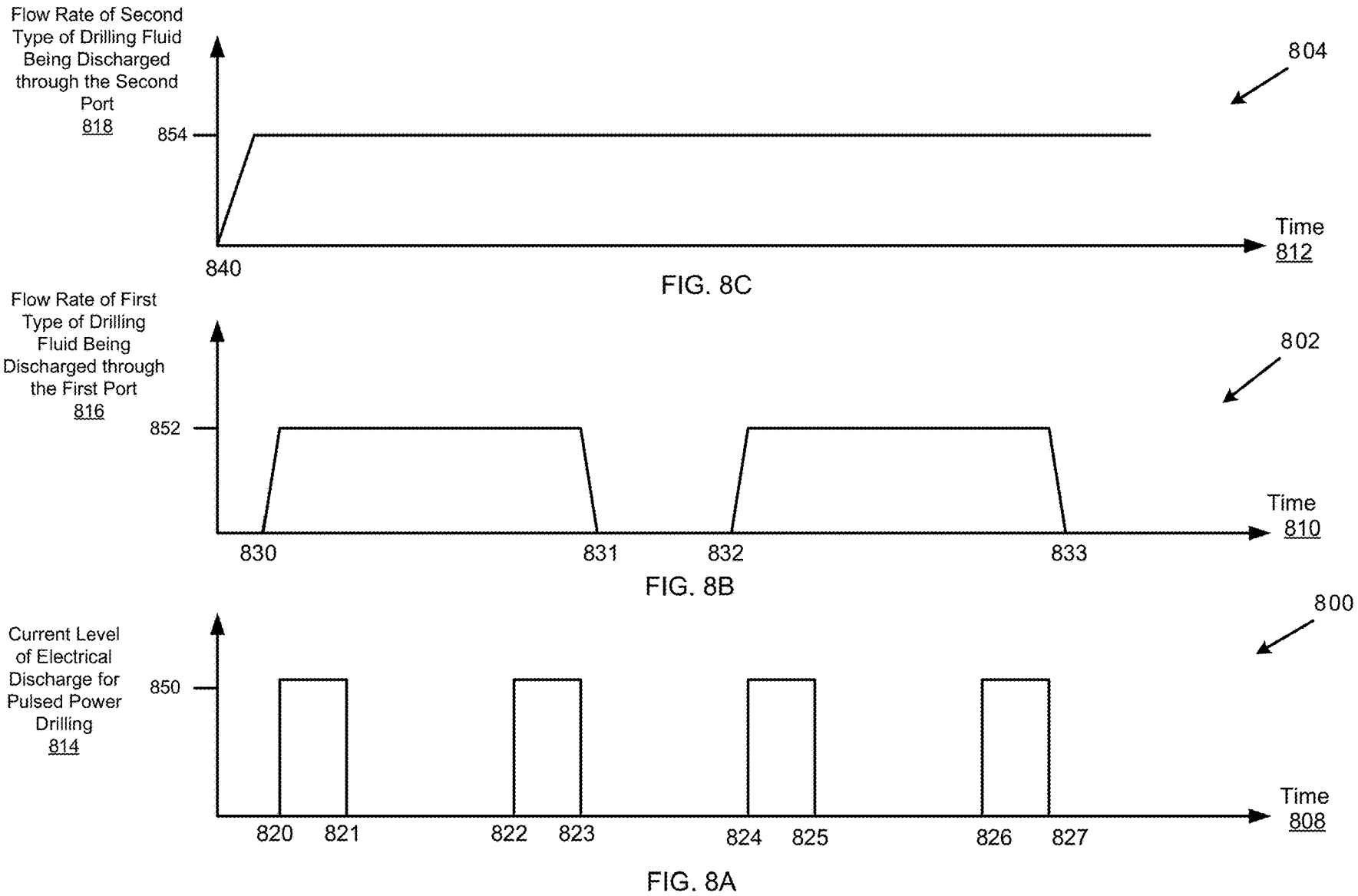
FIGS. 8A-8C are example graphs illustrating a second example, over time, the periodic electrical discharges, the flow rate of the first type of drilling fluid through the first port, and the flow rate of the second type of drilling fluid through the second port, respectively, according to some embodiments.

To further illustrate, FIGS. 8A-8C are example graphs illustrating a second example, over time, the periodic electrical discharges, the flow rate of the first type of drilling fluid through the first port, and the flow rate of the second type of drilling fluid through the second port, respectively, according to some embodiments. In this example as shown, a given periodic output of the first type of drilling fluid from the first port may extend over multiple electrical discharges for the pulsed power drilling.

FIGS. 8A-8C include graphs 800, 802, and 804, respectively. Each of the graphs 800-804 include an x-axis 808-812, respectively, that is time. The graph 800 includes a y-axis 814 that is the current level of electrical discharge being output by the drill bit for pulsed power drilling. The graph 802 includes a y-axis 816 that is the flow rate of the first type of drilling fluid being discharged through the first port (at or near the drill bit). The graph 804 includes a y-axis 818 that is the flow rate of the second type of drilling fluid being discharged through the second port (uphole from the first port).

In this example, as shown in the graph 800 of FIG. 8A, there are periodic current discharges at substantially same current level (see 850). A first discharge starts at a time point 820 and ends at a time point 821. A second discharge starts at a time point 822 and ends at a time point 823. A third discharge starts at a time point 824 and ends at a time point 825. A fourth discharge starts at a time point 826 and ends at a time point 827. These periodic discharges may continue as part of the pulsed power drilling of the wellbore.

In this example, as shown in the graph 802 of FIG. 8B, the first type of drilling fluid may be periodically output at substantially the same flow rate from the first port for a time period that extends across multiple electrical discharges for the pulsed power drilling. A time point 830 is a starting point for a first periodic output of the first type of drilling fluid through the first port (at or near the drill bit). In this example, the time point 830 is before but close to the time point 820 so that the flow rate of the first type of drilling fluid is at or near the maximum flowrate 852 when the electrical discharge begins at the time point 820. A time point 831 is the time at which the first type of drilling fluid stops flowing out from the first port. In this example, the flow rate of the first type of drilling fluid starts reducing at a time point that is equal to or substantially equal to the time point 823.

A time point 832 is a starting point for a second periodic output of the first type of drilling fluid through the first port (at or near the drill bit). In this example, the time point 832 is before but close to the time point 824 so that the flow rate of the first type of drilling fluid is at or near the maximum flowrate 852 when the electrical discharge begins at the time point 824. A time point 833 is the time at which the first type of drilling fluid stops flowing out from the first port. In this example, the flow rate of the first type of drilling fluid starts reducing at a time point that is equal to or substantially equal to the time point 827.

In this example, as shown in the graph 804 of FIG. 8C, the second type of drilling fluid may be output at a constant or substantially constant flow rate (see 854) during the time of the pulsed power drilling. In this example, a time point 840 is the start of the output of the flow of the second type of drilling fluid through the second port. Thus, in the example of FIGS. 8A-8C, the first type of drilling fluid may be periodically output at substantially the same flow rate from the first port for a time period that extends across multiple electrical discharges for the pulsed power drilling.

While the graphs of FIGS. 7A-7C and 8A-8C include example start and end points for the flow rates of the first type of drilling fluid and the second type of drilling fluid, respectively, relative to the periodic pulsing of the electrical discharges, in some other implementations, the starting and end points may be different relative to this periodic pulsing of the electrical discharges. For example, the starting points for periodic output of the first type of drilling fluid may be before or after the starting points for the periodic electrical discharges for the pulsed power drilling. In some examples, the starting points for the flow rates of the first type of drilling fluid through the first port may be timed sufficiently prior to the electrical discharges to allow for the first type of drilling fluid to substantially fill or displace the hole volume immediately proximate the bottom of the drill bit, before the electrical discharges. In some examples, the flow rate of the first type of drilling fluid through the first port may flow continuously for an extended period of time, concurrent with a continuous flow of the second type of drilling fluid through the second port, and the periodic pulsed power discharges as in FIG. 8A. Alternatively or in addition, the flow rate of the second type of drilling fluid may be periodic (similar to the periodic flow rates of the first type of drilling fluid)—that may or may not be dependent on the periodic electrical discharges for the pulsed power drilling.

Example Multi-Fluid/Single-Port Operations

Figure 9:
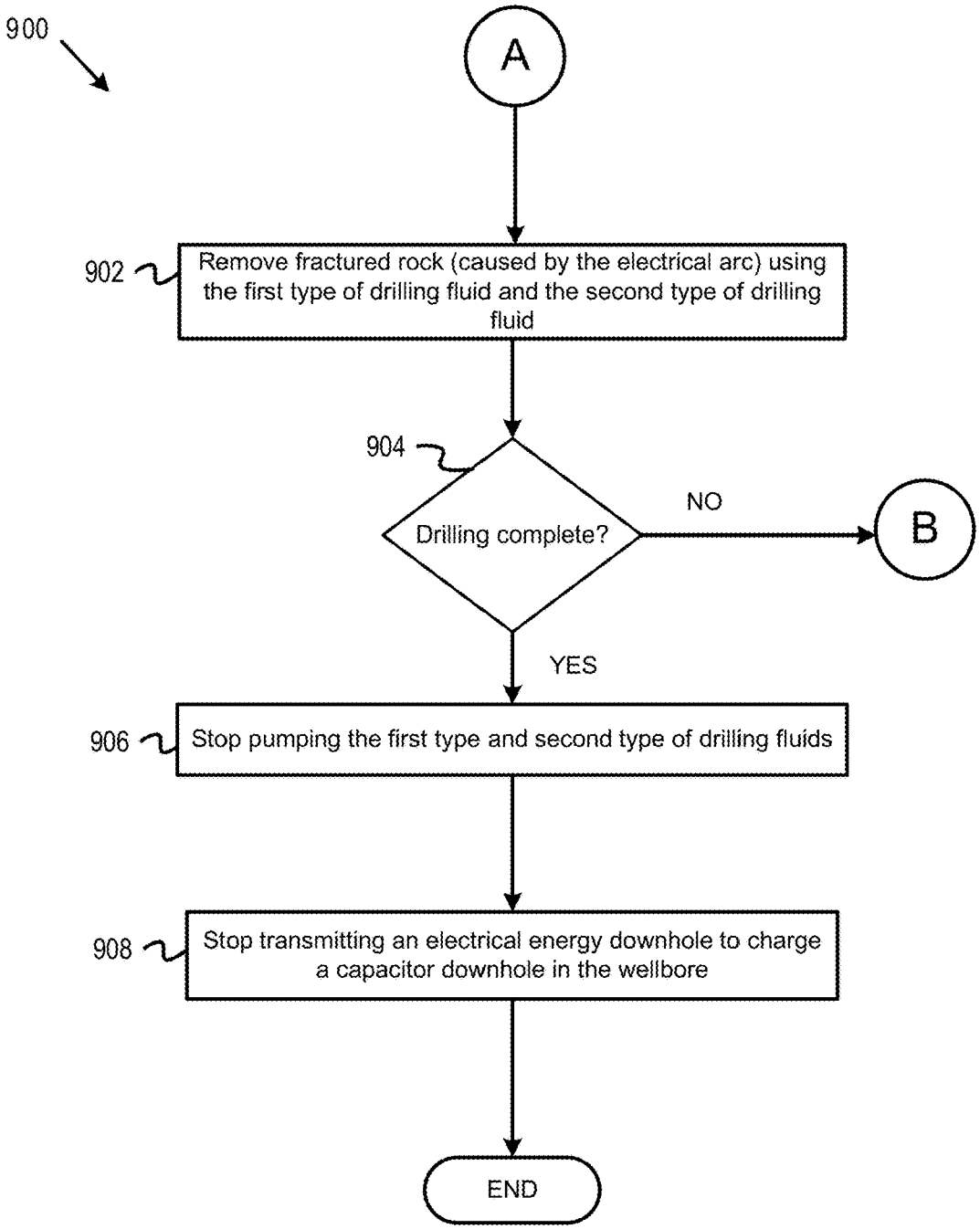
FIGS. 9-10 is a flowchart of second example operations for drilling a wellbore using a same port at or near the face of the drill bit for outputting two different types of drilling fluids, according to some embodiments.
Figure 10:
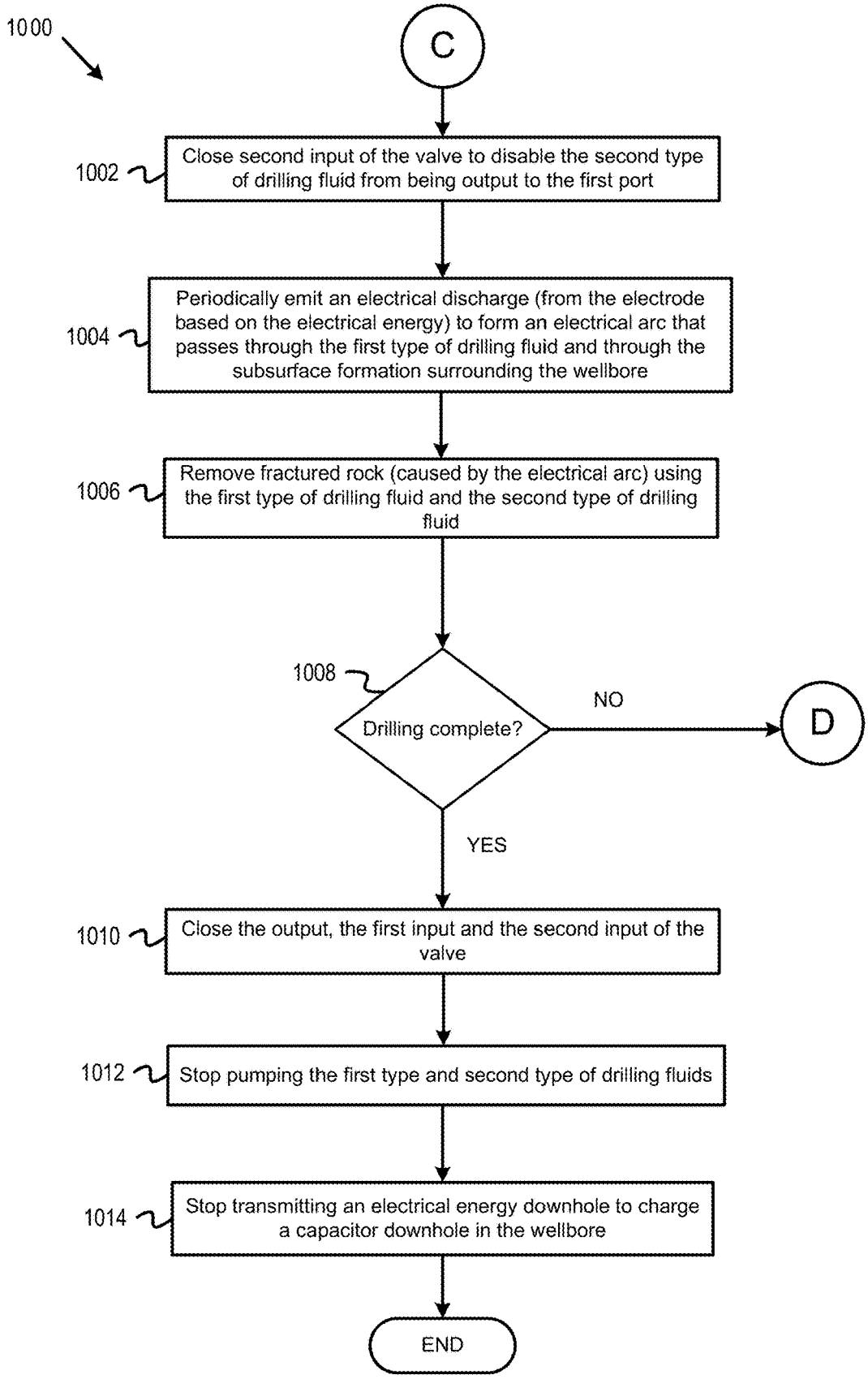

FIGS. 9-10 is a flowchart of second example operations for drilling a wellbore using a same port at or near the face of the drill bit for outputting two different types of drilling fluids, according to some embodiments. Operations of flowcharts 900-1000 of FIGS. 9-10 can be performed by software, firmware, hardware, or a combination thereof. In some implementations, one or more of the operations may be initiated or performed with a human operator's involvement or may be partially or fully automated. Operations of the flowcharts 900-1000 continue between each other through transition points C-D. Operations of the flowcharts 900-1000 are described in reference to FIGS. 1 and 4. However, other systems and components can be used to perform the operations now described. The operations of the flowchart 900 start at block 902.

At block 902, a drill bit is positioned downhole in a wellbore. For example, with reference to FIG. 1, the drill bit 114 may be positioned downhole in the wellbore 116.

At block 904, a first type of drilling fluid is from a surface of the wellbore through an inner coil tubing into a first input of a valve. For example, with reference to FIG. 1, a controller may control the pump 124 to start the pump 124 pumping the first type of drilling fluid 192 down into the wellbore 116 via the inner coil tubing 109.

At block 906, a second type of drilling fluid is pumped from a surface of the wellbore through an outer coil tubing into a second input of the valve. For example, with reference to FIG. 1, a controller may control the pump 124 to cause the pump 124 to start pumping the second type of drilling fluid 190 down into the wellbore 116 via the outer coil tubing 108.

At block 908, an electrical energy is transmitted downhole to charge a capacitor downhole in the wellbore. For example, with reference to FIG. 1, a controller may control the generator 140 to start the generator 140 generating electrical power that is then provided to the power conditioning unit 142 that transmits the electrical energy down the wellbore 116 via the surface cable 143 and a subsurface cable.

At block 910, the output and the second input of the valve are opened to enable the second type of drilling fluid to be output to a first port that is near an electrode from which an electrical discharge is to be emitted. For example, with reference to FIG. 4, the output and the second input of the valve 404 are opened—to enable flow of the second type of drilling fluid 190 to the first port 309.

At block 912, the first input of the valve is closed to disable the first type of drilling fluid to be output to a first port that is near an electrode from which an electrical discharge is to be emitted. For example, with reference to FIG. 4, the first input of the valve 404 is closed—to disable flow of the first type of drilling fluid 192 to the first port 309.

At block 914, a determination is made of whether it is time to perform a periodic electrical discharge to further drill the wellbore. For example, with reference to FIG. 4, a pulse of electrical discharge may be emitted periodically from the electrode 308 and into the subsurface formation. The timing of emission may vary depending on one or more factors-such as whether a capacitor in the BHA 128 is fully charged, whether the drill bit 114 is in contact with or near the bottom of the wellbore 116, etc. In some implementations, these pulses and corresponding arcs may occur between 50 and 500 times per second (having a rise and discharge time between 0.1 and 100 microseconds, or preferably between 10 to 20 microseconds for each arc). If it is not time to perform a periodic electrical discharge to further drill the wellbore, operations of the flowchart 900 remain at block 914 to again make this determination. Otherwise, operations of the flowchart 900 continue at block 916.

At block 916, the valve is opened to enable the first type of drilling fluid to be output to the first port. For example, with reference to FIG. 4, the first input of the valve 404 is opened—to enable flow of the first type of drilling fluid 192 to the first port 309.

Operations of the flowchart 900 continuation a transition point C, which continues at transition point C of the flowchart 1000. From transition point C of the flowchart 1000, operations continue at block 1002.

At block 1002, the second input of the valve is closed to disable the second type of drilling fluid from being output to the first port. For example, with reference to FIG. 4, the second input of the valve 404 is closed—to disable flow of the second type of drilling fluid 190 to the first port 309.

At block 1004, an electrical discharge is periodically emitted (from the electrode based on the electrical energy) to form an electrical arc that passes through the first type of drilling fluid and through the subsurface formation surrounding the wellbore. For example, with reference to FIG. 4, the electrode 308 may emit a pulse of electrical discharge (along with a corresponding arc) through the first type of drilling fluid 192 and into the subsurface formation surrounding the wellbore 116.

At block 1006, fractured rock (caused by the electrical arc) is removed using the first type of drilling fluid and the second type of drilling fluid. For example, with reference to FIG. 1, the drilling fluid 122 circulating back to the surface via an annulus 126 formed between the outer coil tubing 108 and the sidewalls of the wellbore 116 may remove the fractured rock. The drilling fluid 122 may be a combination of the first type of drilling fluid 192 and the second type of drilling fluid 190.

At block 1008, a determination is made of whether drilling is complete. For example, with reference to FIG. 1, a controller at the surface of the wellbore 116 may be configured to stop the current drilling operation based on user input, current depth of the wellbore 116, current duration of the current drilling operation, etc. If drilling is not complete, operations of the flowchart 1000 continue at transition point D, which continues at transition point D at the flowchart 900 at FIG. 9 (which continues at block 912 where the first input valve is closed). If drilling is complete, operations of the flowchart 1000 continue at block 1010.

At block 1010, the output, the first input and the second input of the valve are closed. For example, with reference to FIG. 4, the output, the first input and the second input of the valve 404 are closed—to disable flow of the first type of drilling fluid 192 and the second type of drilling fluid 190 to the first port 309.

At block 1012, pumping the first type and second type of drilling fluids is stopped. For example, with reference to FIG. 1, a controller may control the pump 124 to stop the pump 124 from pumping the first type of drilling fluid 192 and the second type of drilling fluid down into the wellbore 116 via the inner coil tubing 109 and the outer coil tubing 108, respectively.

At block 1014, transmission of an electrical energy downhole to charge a capacitor downhole in the wellbore is stopped. For example, with reference to FIG. 1, a controller may control the generator 140 to stop the generator 140 from generating electrical power that was being provided to the power conditioning unit 142 that transmits the electrical energy down the wellbore 116 via the surface cable 143 and a subsurface cable. Operations of the flowchart 1000 are complete.

In some implementations, timing between the current level of electrical discharge being output from the drill bit for the pulsed power drilling and the flow rates of the first type of drilling fluid and the second type of drilling fluid from the same port may vary. Two such example timings are now described.

Figures 11A, 11B, 11C:
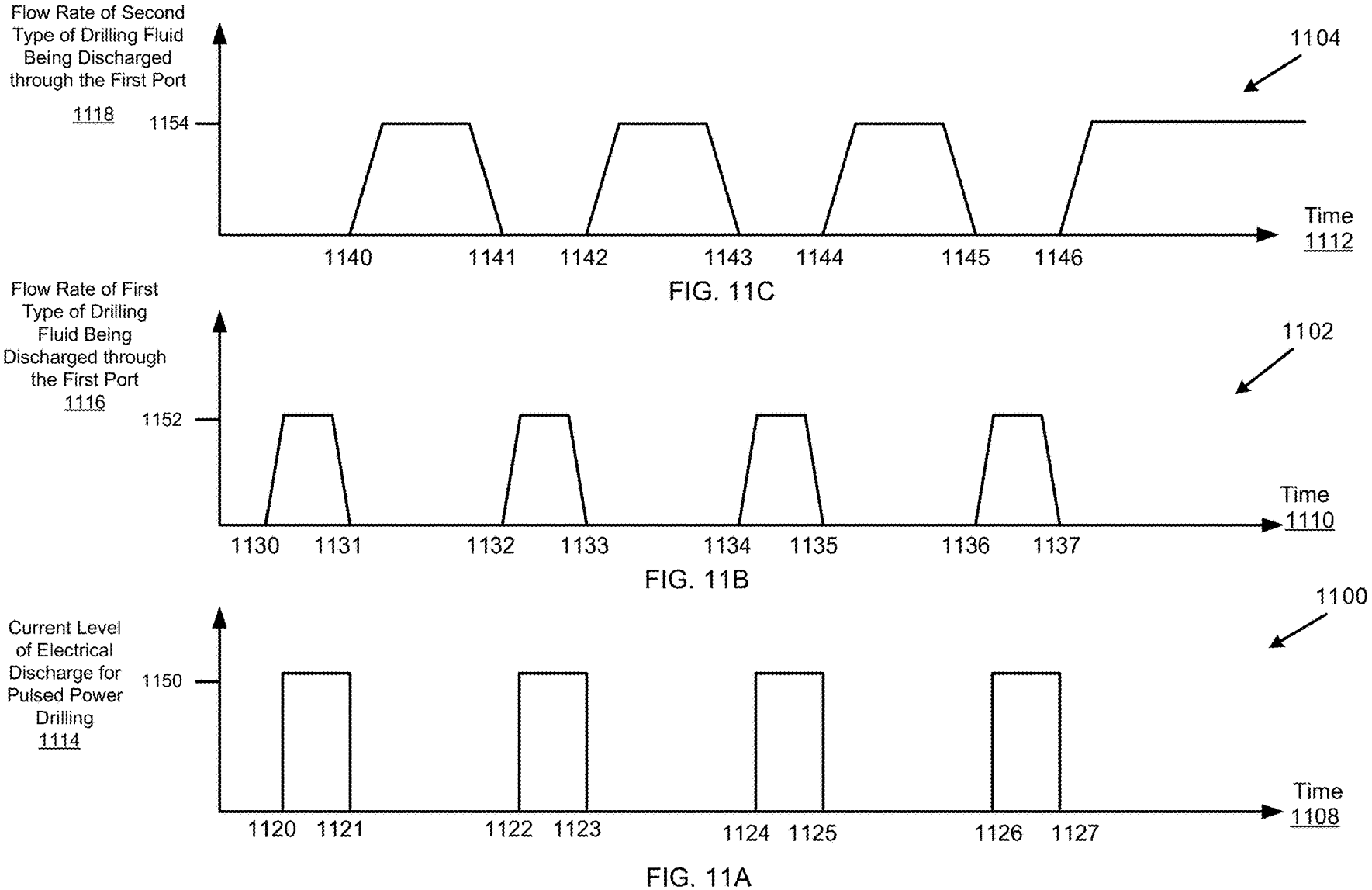
FIGS. 11A-11C are graphs illustrating a first example, over time, the periodic electrical discharges, the flow rate of the first type of drilling fluid through the first port, and the flow rate of the second type of drilling fluid through the same first port, respectively, according to some embodiments.

FIGS. 11A-11C are graphs illustrating a first example, over time, the periodic electrical discharges, the flow rate of the first type of drilling fluid through the first port, and the flow rate of the second type of drilling fluid through the same first port, respectively, according to some embodiments. FIGS. 11A-11C include graphs 1100, 1102, and 1104, respectively. Each of the graphs 1100-1104 include an x-axis 1108-1112, respectively, that is time. The graph 1100 includes a y-axis 1114 that is the current level of electrical discharge being output by the drill bit for pulsed power drilling. The graph 1102 includes a y-axis 1116 that is the flow rate of the first type of drilling fluid being discharged through the first port (at or near the drill bit). The graph 1104 includes a y-axis 1118 that is the flow rate of the second type of drilling fluid being discharged through the same first port.

In this example, as shown in the graph 1100 of FIG. 11A, there are periodic current discharges at substantially same current level (see 1150). A first discharge starts at a time point 1120 and ends at a time point 1121. A second discharge starts at a time point 1122 and ends at a time point 1123. A third discharge starts at a time point 1124 and ends at a time point 1125. A fourth discharge starts at a time point 1126 and ends at a time point 1127. These periodic discharges may continue as part of the pulsed power drilling of the wellbore.

In this example, as shown in the graph 1102 of FIG. 11B, the first type of drilling fluid may be periodically output at substantially the same flow rate from the first port to coincide with the start of each periodic current discharge. A time point 1130 is a starting point for a first periodic output of the first type of drilling fluid through the first port (at or near the drill bit). In this example, the time point 1130 is before but close to the time point 1120 so that the flow rate of the first type of drilling fluid is at or near the maximum flowrate 1152 when the electrical discharge begins at the time point 1120. A time point 1131 is the time at which the first type of drilling fluid stops flowing out from the first port. In this example, the flow rate of the first type of drilling fluid starts reducing at a time point that is equal to or substantially equal to the time point 1121.

A time point 1132 is a starting point for a second periodic output of the first type of drilling fluid through the first port (at or near the drill bit). In this example, the time point 1132 is before but close to the time point 1122 so that the flow rate of the first type of drilling fluid is at or near the maximum flowrate 1152 when the electrical discharge begins at the time point 1122. A time point 1133 is the time at which the first type of drilling fluid stops flowing out from the first port. In this example, the flow rate of the first type of drilling fluid starts reducing at a time point that is equal to or substantially equal to the time point 1123.

A time point 1134 is a starting point for a third periodic output of the first type of drilling fluid through the first port (at or near the drill bit). In this example, the time point 1134 is before but close to the time point 1124 so that the flow rate of the first type of drilling fluid is at or near the maximum flowrate 1152 when the electrical discharge begins at the time point 1124. A time point 1135 is the time at which the first type of drilling fluid stops flowing out from the first port. In this example, the flow rate of the first type of drilling fluid starts reducing at a time point that is equal to or substantially equal to the time point 1125.

A time point 1136 is a starting point for a fourth periodic output of the first type of drilling fluid through the first port (at or near the drill bit). In this example, the time point 1136 is before but close to the time point 1126 so that the flow rate of the first type of drilling fluid is at or near the maximum flowrate 1152 when the electrical discharge begins at the time point 1126. A time point 1137 is the time at which the first type of drilling fluid stops flowing out from the first port. In this example, the flow rate of the first type of drilling fluid starts reducing at a time point that is equal to or substantially equal to the time point 1127.

In this example, as shown in the graph 1104 of FIG. 11C, the second type of drilling fluid may be output from this same first port at time intervals when the first type of drilling fluid is not being output at a constant or substantially constant flow rate (see 1154).

A time point 1140 is a starting point for a first periodic output of the second type of drilling fluid through the first port (at or near the drill bit). In this example, the time point 1140 is at or near the time point 1131 when the flow rate of the first type of drilling fluid is completed for a first time interval. A time point 1141 is the time at which the second type of drilling fluid stops flowing out from the first port. In this example, the flow rate of the second type of drilling fluid stops at or near the time point 1132, which is the start of the second periodic interval of flow of the first type of drilling fluid.

A time point 1142 is a starting point for a second periodic output of the second type of drilling fluid through the first port (at or near the drill bit). In this example, the time point 1142 is at or near the time point 1133 when the flow rate of the first type of drilling fluid is completed for a second time interval. A time point 1143 is the time at which the second type of drilling fluid stops flowing out from the first port. In this example, the flow rate of the second type of drilling fluid stops at or near the time point 1134, which is the start of the third periodic interval of flow of the first type of drilling fluid.

A time point 1144 is a starting point for a third periodic output of the second type of drilling fluid through the first port (at or near the drill bit). In this example, the time point 1144 is at or near the time point 1135 when the flow rate of the first type of drilling fluid is completed for a third time interval. A time point 1145 is the time at which the second type of drilling fluid stops flowing out from the first port. In this example, the flow rate of the second type of drilling fluid stops at or near the time point 1136, which is the start of the third periodic interval of flow of the first type of drilling fluid.

A time point 1146 is a starting point for output of the second type of drilling fluid through the first port (at or near the drill bit). In this example, the time point 1146 is at or near the time point 1137 when the flow rate of the first type of drilling fluid is completed for a fourth time interval.

In some examples, the starting points for the flow rates of the first type of drilling fluid through the first port, and/or the ending points for the flow rates of the second type of drilling fluid through the first port, may be timed sufficiently prior to the electrical discharges to allow for the first type of drilling fluid to substantially displace the second type of drilling fluid from the hole volume immediately proximate the bottom of the drill bit, before the electrical discharges.

Figures 12A, 12B, 12C:
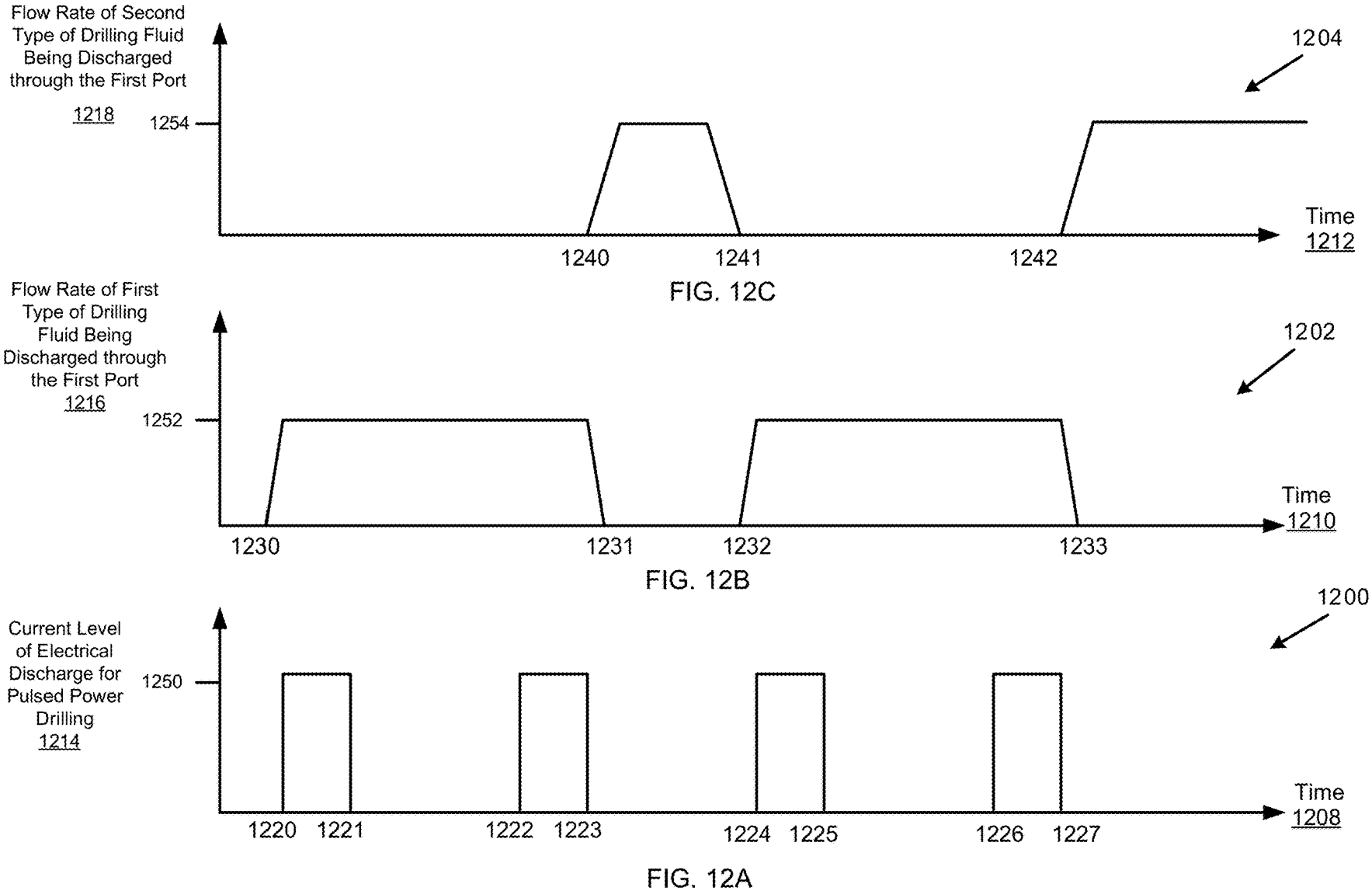
FIGS. 12A-12C are graphs illustrating a second example, over time, the periodic electrical discharges, the flow rate of the first type of drilling fluid through the first port, and the flow rate of the second type of drilling fluid through the same first port, respectively, according to some embodiments.

FIGS. 12A-12C are graphs illustrating a second example, over time, the periodic electrical discharges, the flow rate of the first type of drilling fluid through the first port, and the flow rate of the second type of drilling fluid through the same first port, respectively, according to some embodiments. FIGS. 12A-12C include graphs 1200, 1202, and 1204, respectively. Each of the graphs 1200-1204 includes an x-axis 1208-1212, respectively, that is time. The graph 1200 includes a y-axis 1214 that is the current level of electrical discharge being output by the drill bit for pulsed power drilling. The graph 1202 includes a y-axis 1216 that is the flow rate of the first type of drilling fluid being discharged through the first port (at or near the drill bit). The graph 1204 includes a y-axis 1218 that is the flow rate of the second type of drilling fluid being discharged through the same first port.

In this example, as shown in the graph 1200 of FIG. 12A, there are periodic current discharges at substantially same current level (see 1250). A first discharge starts at a time point 1220 and ends at a time point 1221. A second discharge starts at a time point 1222 and ends at a time point 1223. A third discharge starts at a time point 1224 and ends at a time point 1225. A fourth discharge starts at a time point 1226 and ends at a time point 1227. These periodic discharges may continue as part of the pulsed power drilling of the wellbore.

In this example, as shown in the graph 1202 of FIG. 12B, the first type of drilling fluid may be periodically output at substantially the same flow rate from the first port across two periodic current discharges. A time point 1230 is a starting point for a first periodic output of the first type of drilling fluid through the first port (at or near the drill bit). In this example, the time point 1230 is before but close to the time point 1220 so that the flow rate of the first type of drilling fluid is at or near the maximum flowrate 1252 when the electrical discharge begins at the time point 1220. A time point 1231 is the time at which the first type of drilling fluid stops flowing out from the first port. In this example, the flow rate of the first type of drilling fluid starts reducing at a time point that is equal to or substantially equal to the time point 1223.

A time point 1232 is a starting point for a second periodic output of the first type of drilling fluid through the first port (at or near the drill bit). In this example, the time point 1232 is before but close to the time point 1224 so that the flow rate of the first type of drilling fluid is at or near the maximum flowrate 1252 when the electrical discharge begins at the time point 1224. A time point 1233 is the time at which the first type of drilling fluid stops flowing out from the first port. In this example, the flow rate of the first type of drilling fluid starts reducing at a time point that is equal to or substantially equal to the time point 1227.

In this example, as shown in the graph 1204 of FIG. 12C, the second type of drilling fluid may be output from this same first port at time intervals when the first type of drilling fluid is not being output at a constant or substantially constant flow rate (see 1254).

A time point 1240 is a starting point for a first periodic output of the second type of drilling fluid through the first port (at or near the drill bit). In this example, the time point 1240 is at or near the time point 1231 when the flow rate of the first type of drilling fluid is completed for a first time interval. A time point 1241 is the time at which the second type of drilling fluid stops flowing out from the first port. In this example, the flow rate of the second type of drilling fluid stops at or near the time point 1232, which is the start of the second periodic interval of flow of the first type of drilling fluid.

A time point 1242 is a starting point for output of the second type of drilling fluid through the first port (at or near the drill bit). In this example, the time point 1242 is at or near the time point 1233 when the flow rate of the first type of drilling fluid is completed for a second time interval.

While the graphs of FIGS. 11A-11C and 12A-12C include example start and end points for the flow rates of the first type of drilling fluid and the second type of drilling fluid, respectively, relative to the periodic pulsing of the electrical discharges, in some other implementations, the starting and end points may be different relative to this periodic pulsing of the electrical discharges. For example, the starting points for periodic output of the first type of drilling fluid may be before or after the starting points for the periodic electrical discharges for the pulsed power drilling. Alternatively or in addition, the flow rate of the second type of drilling fluid may be a continuous flow from the first port (instead of in flow intervals).

Example Implementations for Separation of the Multiple Drilling Fluids

Example implementations for separation of the multiple drilling fluids are now described.

In some implementations, the two types of drilling fluids (the first type of drilling fluid and the second type of drilling fluid) may remain essentially distinct or separate from each other-even though there is a single return conduit for returning the drilling fluids from downhole back to a surface of the wellbore. In particular, some implementations may be used for maintaining the two different drilling fluids as distinct from each other over a long duration of operations.

For example, with reference to FIG. 1, both the first type of drilling fluid 192 and the second type of drilling fluid 190 return to the surface of the wellbore 116 via the annulus 126 (shown as the drilling fluid 122). Thus, in the example of FIG. 1, the first type of drilling fluid 192 and the second type of drilling fluid 190 return to the surface of the wellbore 116 via a single return path (the annulus 126). In some implementations, the first type of drilling fluid 192 and the second type of drilling fluid 190 may share the return path and yet remain sufficiently segregated from each other to enable separation at surface so that each fluid may be returned to its own storage tank and be further processed (ideally minimally) prior to pumping back downhole in respective designated conduits.

As described above, some implementations may include a tortuous path and potentially a pumping device along the BHA, so that when the first type of drilling fluid 192 is routed through a face of the drill bit 114 and then back into the annulus 126 above the drill bit 114 (together with wellbore cuttings) and to continue to the surface of the wellbore 116 via the annulus 126 along with the second type of drilling fluid 190, there may be a separation between the first type of drilling fluid 192 and the second type of drilling fluid 190. However, in these implementations, the first type of drilling fluid 192 and the second type of drilling fluid 190 may ultimately mix in the annulus as they are returning to the surface of the wellbore 116.

Accordingly, some implementations may include separation of the two different fluids at the surface of the wellbore 116, supplementing and/or treatment of at least one of the two different fluids, in order to maintain reserves of each of the two fluids with the requisite properties, for continual pumping back downhole. Different example implementations for such separation of the two fluids (which may be enabled by the particular compositions of the two fluids) at the surface of the wellbore 116 in order to limit mixing of these two fluids downhole and/or enhance their separability at the surface of the wellbore 116 are now described.

In some implementations, the first type of drilling fluid 192 may have a higher viscosity than the second type of drilling fluid 190. Accordingly at the surface of the wellbore 116, the combined fluids returning via the annulus 126 may be input into a viscosity-based separator in order to separate the two different fluids. In some implementations, in order to provide a higher viscosity in the first type of drilling fluid 192, napalm (e.g., sodium palmate oil, treated with calcium), may be added into the first type of drilling fluid 192. Alternatively or in addition, additives may be added to the second type of drilling fluid 190. Examples of such additives may include viscoelastic surfactant in the water phase, which would become more viscous when transitioning from the tubular where it is at a higher flow velocity, to the annulus 126 (at lower velocity and shear rate)

These chemical additives in one or the other phases may promote or result in an increased viscosity versus lower viscosity phases and/or at least one of the phases to agglomerate within the other phase (and in any case to reduce mixability (and slow diffusion)) between the phases. The phases may then continue on the return trip to surface of the wellbore 116 without full mixing (and ideally with very little mixing) between them, to be easier to separate at surface. A viscosity based separation system may be then used at surface of the wellbore 116 (as described above).

Some implementations may include a downhole valve system that may alternate the flow between the first type of drilling fluid 192 and the second type of drilling fluid 190. In such implementations the shared returned path (the annulus 126) may include alternating slugs of the two different fluid types (which may be any duty cycle). These alternating slugs may travel to surface of the wellbore 116 with the distinct phases retained. A surface system may include valving that is timed and/or responsive to sensors to direct the one phase to one tank, and the other phase to the other tank.

In some implementations, a magneto-rheological (MR) fluid may be included as a component of one of the two fluids. At the surface of the wellbore 116, the return fluid flow may be energized by a magnetic field, to result in segregation of the first type of drilling fluid 192 and the second type of drilling fluid 190.

In some implementations, a fluid flow modeling may be used to determine what pumping rate of one or both of the fluids will result in laminar flow for at least one, or both, or the combination of the two fluids in the annulus 126, for the return to surface, and laminar flow on the return may help to maintain the order of fluid slugs, the agglomeration, and or limit the mixing between the two fluid phases.

In some implementations, one or more different separation operations may be used to separate the two fluids from each other at the surface. Examples of such separation operations may include centrifuge, settling, semi-permeable membrane, distillation, crystallization, etc.

In some implementations, the two different fluids may have distinct round trip flow paths. In particular, two completely distinct round trip flow paths may be established for (1) the first type of drilling fluid 192, which may be a dielectric fluid required at the bit face, and (2) the second type of drilling fluid 190, which may be at a greater volumetric flow rate. To help illustrate, FIG. 13 is a cross-sectional view of a portion of a pulsed power drilling system having two completely distinct round trip flow paths for the two drilling fluids, according to some implementations.

Figure 13:
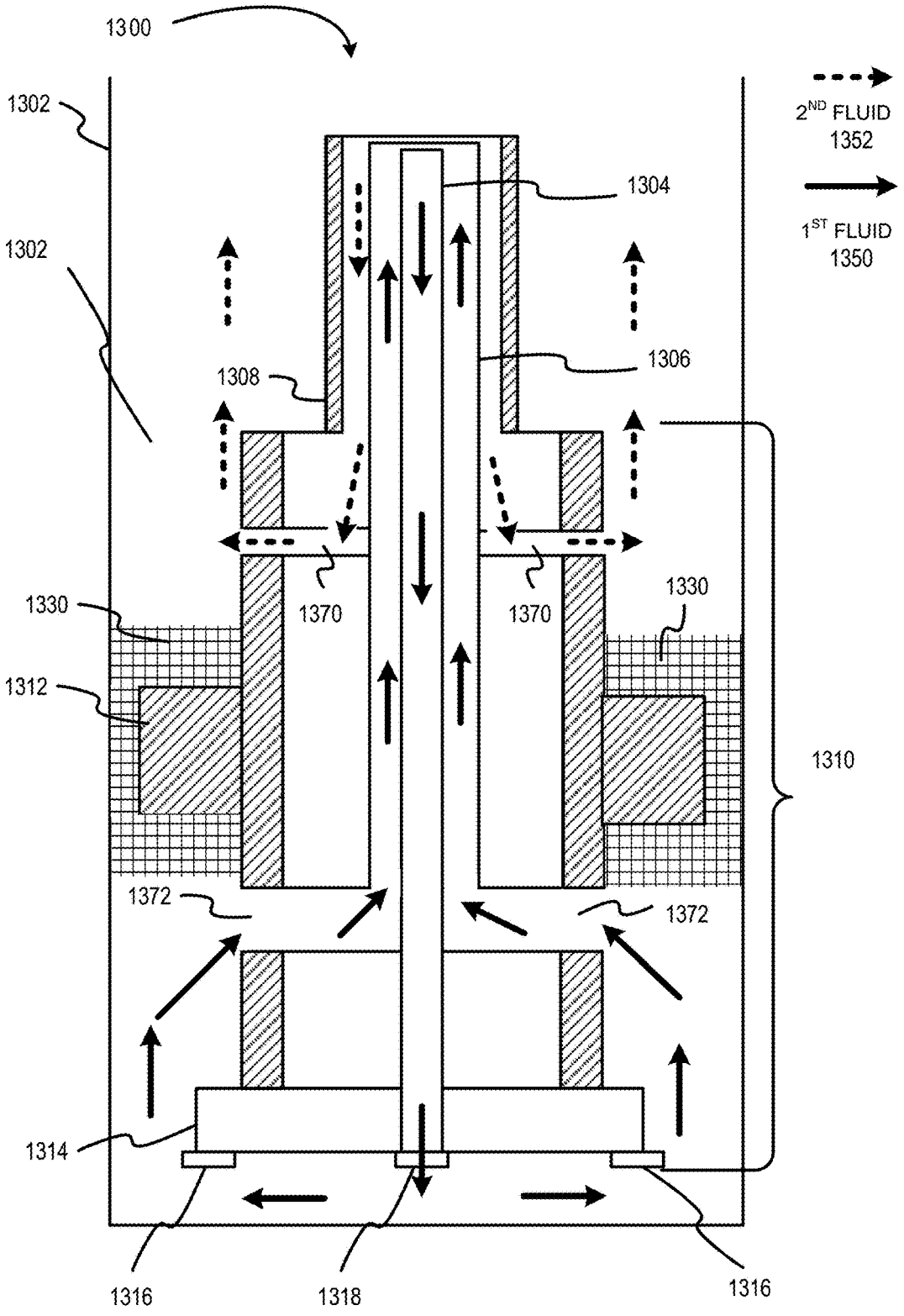
FIG. 13 is a cross-sectional view of a portion of a pulsed power drilling system having two completely distinct round trip flow paths for the two drilling fluids, according to some implementations.

FIG. 13 includes a wellbore 1300 into which a bottom hole assembly (BHA) 1310 is positioned. An outer tubular 1308 couples the BHA 1310 to equipment (not shown) at the surface of the wellbore 1300. The outer tubular 1308 may be coiled tubing, drill pipe, etc. An annulus 1302 is defined between a wall 1301 of the wellbore 1300 and the outer tubular 1308 and the BHA 1310.

The BHA 1310 includes a pulsed power drill bit 1314 having a ground ring 1316 and an electrode 1318. An outer conduit 1306 is positioned within the outer tubular 1308. An inner conduit 1304 is positioned within the outer conduit 1306. There is also a buffer zone (or interface) 1330 positioned downhole in the annulus 1302 between ports 1370 and ports 1372.

In this example, there are two types of drilling fluids—a first type of drilling fluid 1350 and a second type of drilling fluid 1352 (and are similar to the two types of drilling fluids described above). As shown, the first type of drilling fluid 1350 flows from a surface of the wellbore 1300 down through the inner conduit 1304 and out through or around the electrode 1318. The first type of drilling fluid 1350 then returns back uphole via the annulus 1302 (below the buffer zone 1330) and through the ports 1370 and through the outer conduit 1304. The second type of drilling fluid 1352 flows from a surface of the wellbore 1300 down through the outer tubular 1308 and out through the ports 1372. The second type of drilling fluid 1352 then returns back uphole to the surface of the wellbore 1300 via the annulus 1302 (above the buffer zone 1330).

As shown, these two distinct flow paths (for the first type of drilling fluid 1350 and the second type of drilling fluid 1352) may be maintained as substantially separate (not mixing)—even though there is a buffer zone 1330 where the two distinct flow paths are proximate to each other and without some deliberate engineering might mix.

Also, as shown, the second type of drilling fluid 1352 (which may be the main bulk fluid e.g., water based and/or without high-dielectric properties) may be pumped down the largest diameter conduit—the tubing 1308. The second type of drilling fluid 1352 may be ported into the annulus 1302 above the buffer zone 1330 (and then returning up the annulus 1302 or reverse circulation through these flow channels.

Additionally, the first type of drilling fluid 1350 may be a high dielectric fluid having a flow path down the inner conduit 1304, through the bit and at the bottom of the wellbore 1300 and back up the outer conduit 1306 (which may be concentric with or parallel to the inner conduit 1304—or reverse circulation through this flow path).

In some implementations, there may be particular challenges in maintaining these two fluids as distinct with little mixing. Zero mixing might not be practical, but minimizing the mixing is still of value, and the techniques discussed further above may be used to separate, at surface, the portion of fluids that had mixed downhole and/or allowing the bulk fluid to continue to be used with some contamination from the dielectric fluid, with supplementing of the volume of the dielectric fluid at surface; and/or surface treatment of one or both fluids at surface to maintain the distinct property sets required.

Some implementations for maintaining the two flow paths as distinct include the distinct flow paths noted above in reference to FIG. 13. This may include the one or more openings or ports through the BHA or outer conduit immediately above the bit face or higher on the BHA or outer conduit, with the dielectric fluid to use this pathway, and with the ports for the bulk fluid just above the ports for the dielectric fluid. Such implementations would include a fluid interface or mixing zone between the two fluids (the buffer zone 1330) in the annulus 1302 somewhere above the bit face. Ideally, a distinct interface is achieved, with little mixing. There may be a number of implementations for minimizing the mixing. Such implementations are now described.

1st Approach for Minimizing Mixing of the Two Fluids

A first approach for minimizing mixing of the two fluids may include an interface zone between the two fluids. In some implementations, at the onset of drilling, after the drilling BHA has been tripped to bottom, and the wellbore 1300 and all the tubulars (1304-1308) are full of the second type of drilling fluid 1352 (i.e. the bulk fluid that does not have the dielectric properties), the first type of drilling fluid 1350 may be pumped from surface through the inner conduit 1304 to the drill bit (displacing the second type of drilling fluid 1352). Alternatively, the inner conduit 1304 may be pre-filled with the first type of drilling fluid 1350. Then, in either case, the first type of drilling fluid 1350 may be pumped to displace the second type of drilling fluid 1352 from around the bit and up the outside of the BHA to the ports connected to the return conduit.

Alternatively, the inner conduit 1304 may be pre-filled with the first type of drilling fluid 1350. And then in either case, the first type of drilling fluid 1350 may be pumped to displace the second fluid from around the bit and up the outside of the BHA to the ports connected to the return conduit (the outer conduit 1306). In some implementations, the outer conduit 1306 may be pre-filled as well with the first type of drilling fluid 1350, or pumping may continue for the second type of drilling fluid 1352 to be displaced all the way to surface of the wellbore 1300 (and piped to the holding tank for the second type of drilling fluid 1352 (and not mixing with the holding tank for the first type of drilling fluid 1350)). As this establishing of the circuit for the first type of drilling fluid 1350 is being done, the second type of drilling fluid 1352 may be present in the two annular regions. The first annular region is the annulus 1302 (between the outer diameter of the outer tubular 1308 and the wall 1301 of the wellbore 1300. The second annular region may be between the outer tubular 1308 and the inner tubulars (the outer conduit 1306 and the inner conduit 1304).

In some implementations, sensors may be positioned outside the BHA and used to locate the fluid interface between the first type of drilling fluid 1350 and the second type of drilling fluid 1352. For example, the sensors may be electrical sensors that may discriminate between oil-based and water-based fluids. The measurements made by the sensors may be processed to determine the fluid interface. For example, in some implementations, a wireline may be used with or within one of the tubulars for transmission of these measurements to the surface of the wellbore 1300 for such processing. Alternatively or in addition, such processing may be performed downhole. Based on such processing, the location of the fluid interface may be adjusted by pumping fluid into and/or out of each of fluid circuits (one for the first type of drilling fluid 1350 and one for the second type of drilling fluid 1352). In some implementations, the location of the fluid interface may be similarly managed during drilling. In some implementations, a bladder or reservoir may be employed downhole as part of the BHA with a pump to supplement (or remove) dielectric fluid from the interface zone 1330.

As drilling proceeds, the two fluids may be pumped separately through the two fluid circuits described. Each fluid may provide its particular functionality. In particular, the first type of drilling fluid 1350 may be a dielectric fluid to support the pulsed power rock removal and cuttings transport to surface. The second type of drilling fluid 1352 may be a bulk fluid providing the common drilling fluid functions (such as pressure control and wellbore stability, and potentially being water based which may be economically and environmentally preferred).

In some implementations, certain pairings of the first type of drilling fluid 1350 and the second type of drilling fluid 1352 may be preferred for the natural incompatibility between the two (i.e., the two fluids won't easily mix, or if they do, are more feasible to separate from each other at surface). Example pairings may include the first type of drilling fluid 1350 being a high dielectric constant oil such as propylene carbonate or butylene carbonate, and the second type of drilling fluid 1352 being a water based mud. In some implementations, the second type of drilling fluid 1352 may include acetonitrile or methyl nitrate (with water as above), or ethyl lactate or glycerin, with high density monovalent brine. In some implementations, the first type of drilling fluid 1350 may include ethanol as dielectric fluid, the second type of drilling fluid 1352 may include perfluro-hydrocarbons.

2nd Approach for Minimizing Mixing of the Two Fluids

A second approach for minimizing mixing of the two fluids may be similar to the first approach but also using a fluid pill for interface zone. For example, in some implementations, in establishing the downhole fluid volumes as discussed above for the first approach, a third composition fluid pill may be circulated as the leading edge of the first type of drilling fluid 1350 or the second type of drilling fluid 1352, through one or the other conduits discussed above. Such implementations may be done using pump volumetric timing, and/or using sensors proximate the fluid interface location to sense arrival of the fluid pill. This fluid pill may thereby be placed at the desired interface location so as to establish a buffer zone (see 1330) between the first type of drilling fluid 1350 and the second type of drilling fluid 1352.

Alternatively, the fluid pill may alternatively be carried downhole in an isolated bladder or reservoir (e.g. a long cylinder with a piston, or another parallel tubing), or via a capillary tubing (additional to the other tubulars discussed) run from surface of the wellbore 1300, and ejected to the desired interface location while downhole, and maybe with periodic metered supplementing as required.

In some implementations, the fluid pill may have properties that make the fluid pill unlikely to mix with the first type of drilling fluid 1350 and the second type of drilling fluid 1352. Examples of such buffer fluids for the fluid pill may include a highly viscosified water based pill, using xanthan, viscoelastic surfactants, diutan, cross linked guar, etc. Perflurohydrocarbons may also be used as a buffer fluid.

As shown in FIG. 13, the ports 1370 and the ports 1372 for the first type of drilling fluid 1350 and the second type of drilling fluid 1352, respectively, may be positioned some length from each other. Accordingly, the transiting of each of the two main fluids through the ports 1370 and 1372 may be significantly isolated from the fluid pill in between (1330).

In some implementations, sensors may be used on the BHA at the desired boundaries of the buffer zone 1330, to detect the two main fluids or to detect the buffer fluid, or simply a transition from one to the other, at that interface location. Additionally, such sensors may be used to detect when the buffer zone is reducing in buffer length to the point of no longer being effective. In such situations, additional steps may be taken to reestablish the buffer zone 1330. Those steps may include ejecting additional fluid from a downhole bladder or circulating another pill from surface of the wellbore 1300.

In some implementations that use of a buffer fluid zone, as the drill string advances (i.e., as rock is removed—for example at one to two feet per minute), the volumes of the two circulation paths may increase. In relation to the coiled tubing portion of the circulation path(s), the volumes may stay constant as the coil is simply being conveyed from a surface reel into the wellbore 1300 and not changing its volume. However, the annulus 1302 annular region (between outer pipe and the wall 1301 of the wellbore 1300) is increasing in length, and in relation to the circulation path involving that annulus, the volume increases accordingly. Therefore, in order to maintain the co-location of the buffer zone fluid and the particular section of BHA where it is intended to be resident, the overall volumes of fluid in circulation (at least in regard to the second type of drilling fluid 1352 may need to be increased incrementally and continuously. This may be done with a slight increase in mud pump rate, possibly together with surface choke, and ideally with input from the sensors as discussed above.

3$^{rd}$ Approach for Minimizing Mixing of the Two Fluids

A third approach may include having an interface fluid that has a magnetic property. For example, the interface fluid may be a magneto-rheological (MR) fluid. In such implementations, the intended interface zone may be magnetically maintained at a relatively constant axial location above the bit even as the assembly continues to drill.

In some implementations, a magnetic field may be established at that desired interface location, e.g. using an electromagnet built into a non-magnetic section of the BHA. Thus, the electromagnet may energize the magnetic fluid which results in change in its properties (e.g., viscosity, yield strength, etc.) to result in an effective buffer zone between the two main circulating fluids (thereby limiting mixing).

In some implementations, one or more stabilizers or other vaned structures may be included in or around this interface zone 1330 (see 1312), to take up part of the annular volume. Such implementations leave less volume which the magnetic fluid needs to occupy and effectively block the two main fluids from mixing. While described in reference to this third approach, the use of stabilizers may also be used in the other approaches described herein.

The magnetic field may be adjusted on/off and/or its strength varied to adjust mechanical properties of the fluid. In some implementations, the magnets or electromagnets may be located and orientated (including the poles oriented) in or along the BHA so as to establish (when magnets energized) magnetic flux lines at a preferred orientation to the BHA. For example, the magnets or electromagnets may be oriented perpendicular to the outer diameter of the BHA (thus resulting in the energized magnetic fluid being stiff (as compared to in the unenergized state) and thereby maintaining a buffer zone to separate the first type of drilling fluid 1350 and the second type of drilling fluid 1352 being circulated).

The modulating of magnetic fluid properties may be controlled electrically via wireline from surface, or from batteries in the BHA. A processor may be used to control the energizing of the magnetic fluid responsive to the operation and/or sensors measuring the locations of the three fluids in the annulus 1302. In some implementations, the magnetic fluid may be circulated into the buffer zone 1312 using any of the methods described above in reference to the first approach.

4$^{th}$ Approach for Minimizing Mixing of the Two Fluids

A fourth approach may include use of a solid material (such as elastomer, plastic, etc.). A compliant solid material may be positioned in the buffer zone 1312 (outside of the BHA above the bit where there is need for the fluid separation. In some implementations, the outer diameter of this solid material may be the same or close to the inner diameter of the wellbore 1300.

In some implementations, an elastomer may be used that has an unconstrained outer diameter that is larger than the inner diameter of the wellbore 1300. This elastomer material may compress while being positioned downhole in the wellbore 1300 (thereby sealing against the wall 1301 of the wellbore 1300. In some implementations, the elastomer may be reenforced with metal spring elements. In some implementations, stabilizers may be included above and below the elastomer section so as to keep the BHA centered and limiting eccentric loading on the compliant material. In some implementations, a packer may be used, which may be adjustable. The packer may include spring elements and/or be energized hydraulically and may seal or partially seal along the wall 1301 of the wellbore 1300 to provide the fluid separation.

Some leakage of the first type of drilling fluid 1350 may be designed into the system (e.g., a deliberate gap between the inner diameter of the wellbore and the outer diameter of the solid material or packer). In some implementations, the sealing element may be adaptively energized to result in a small leakage. This may reduce drag of the sealing element which may otherwise impede penetration of the BHA down the wellbore as the wellbore is being drilled and may lubricate the sealing surface and limit drag and wear of that surface.

While the aspects of the disclosure are described with reference to various implementations and exploitations, it will be understood that these aspects are illustrative and that the scope of the claims is not limited to them. In general, techniques for simulating drill bit abrasive wear and damage during the drilling of a wellbore as described herein may be implemented with facilities consistent with any hardware system or hardware systems. M any variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE IMPLEMENTATIONS

Implementation #1: An apparatus that is part of a drill string for drilling a wellbore in a subsurface formation, the apparatus comprising: a drill bit that includes at least one electrode coupled to a power source, the at least one electrode to periodically emit an electrical discharge based on electrical pulses received from the power source; and a first port to output a first type of drilling fluid having a different composition than a second type of drilling fluid to flow downhole for removal of cuttings, wherein the electrical discharge is to be transmitted through the first type of drilling fluid and through a rock of the subsurface formation, wherein the first type of drilling fluid is to flow through a port on a face of the electrode.

Implementation #2: The apparatus of Implementation #1, wherein an additive or a property of at least one of the first type of drilling fluid or the second type of drilling fluid reduces mixability between the first type of drilling fluid and the second type of drilling fluid.

Implementation #3: The apparatus of Implementation #2, wherein the property comprises viscosity, wherein the first type of drilling fluid has a higher viscosity than the second type of drilling fluid.

Implementation #4: The apparatus of Implementation #1, further comprising a ground structure proximate to the at least one electrode, wherein a return path of the electrical discharge includes the ground structure after the electrical discharge is transmitted through the first type of drilling fluid and the rock of the subsurface formation.

Implementation #5: The apparatus of Implementation #1, wherein the second type of drilling fluid is to flow through a second port that is positioned uphole from the first port.

Implementation #6: A system for pulsed power drilling a wellbore into a subsurface formation, the system comprising: a drill bit that includes at least one electrode coupled to a power source, the at least one electrode to periodically emit an electrical discharge based on electrical pulses received from the power source; and a first port to output a first type of drilling fluid having a different composition than a second type of drilling fluid to flow downhole for removal of cuttings, wherein the electrical discharge is to be transmitted through the first type of drilling fluid and through a rock of the subsurface formation, wherein an additive or a property of at least one of the first type of drilling fluid or the second type of drilling fluid reduces mixability between the first type of drilling fluid and the second type of drilling fluid.

Implementation #7: The system of Implementation #6, wherein the property comprises viscosity, wherein the first type of drilling fluid has a higher viscosity than the second type of drilling fluid.

Implementation #8: The system of Implementation #6, wherein the second type of drilling fluid includes the additive that comprises a viscoelastic surfactant.

Implementation #9: The system of Implementation #6, wherein the first type of drilling fluid or the second type of drilling fluid comprises a magneto-rheological fluid, wherein the system comprises, a separator to be positioned at or near a surface of the wellbore, wherein the separator is to receive a return fluid that includes the first type of drilling fluid and the second type of drilling fluid from an annulus of the wellbore; and separate, essentially, the return fluid into essentially the first type of drilling fluid and the second type of drilling fluid based on application of a magnetic field.

Implementation #10: The system of Implementation #6, wherein the property comprises a pumping rate of the at least one of the first type of drilling fluid or the second type of drilling fluid downhole into the wellbore and out into an annulus, defined between a drill string that includes the drill bit and a wall of the subsurface formation, for a return to a surface of the wellbore, wherein the pumping rate of the at least one of the first type of drilling fluid or the second type of drilling fluid is such that a laminar flow for the at least one of the first type of drilling fluid or the second type of drilling fluid.

Implementation #11: The system of Implementation #6, further comprising a downhole valve system configured to alternate a flow of fluid, from downhole via an annulus, defined between a drill string that includes the drill bit and a wall of the subsurface formation, back to a surface of the wellbore, between slugs of the first type of drilling fluid and slugs of the second type of drilling fluid.

Implementation #12: The system of Implementation #11, further comprising: a separator to be positioned at or near a surface of the wellbore, wherein the separator is to receive the first type of drilling fluid and the second type of drilling fluid; and separate, essentially, the first type of drilling fluid from the second type of drilling fluid.

Implementation #13: The system of Implementation #12, wherein the separator comprises at least one of centrifuge, settling device, semi-permeable membrane, distillation device, or crystallization device.

Implementation #14: The system of Implementation #6, wherein the additive or the property of at least one of the first type of drilling fluid or the second type of drilling fluid that reduces mixability between the first type of drilling fluid and the second type of drilling fluid comprises at least one of viscosity, a viscoelastic surfactant, a magneto-rheological fluid, or a pump rate, wherein the system comprises, a first flow path for flow of the first type of drilling fluid from a surface of the wellbore down and returning from downhole and back to the surface of the wellbore; and a second flow path that is separate from the first flow path and for flow of the second type of drilling fluid from a surface of the wellbore down and returning from downhole and back to the surface of the wellbore.

Implementation #15: The system of Implementation #14, further comprising: a processor; and one or more computer-readable media including instructions that, when executed by the processor, cause the processor to perform operations, the instructions comprising, instructions to increase a flow rate of the second type of drilling fluid as drilling of the wellbore advances to account for more space in an annulus defined between a drill string that includes the drill bit and a wall of the subsurface formation.

Implementation #16: The system of Implementation #14, wherein an annulus is, defined between a drill string that includes the drill bit and a wall of the subsurface formation, wherein the system comprises, at least one sensor is to be positioned downhole in the wellbore at designated boundaries of a buffer zone that is created in the annulus between the first type of drilling fluid and the second type of drilling fluid, wherein the at least one sensor is to detect a composition of at least one the first type of drilling fluid and the second type of drilling fluid; a processor; and one or more computer-readable media including instructions that, when executed by the processor, cause the processor to perform operations, the instructions comprising, instructions to receive the composition that is detected by the at least one sensor; instructions to determine the composition; instructions to determine a location of a fluid interface between the first type of drilling fluid and the second type of drilling fluid based on the determined composition; and instructions to adjust a pump rate of at least one of the first type of drilling fluid or the second type of drilling fluid to adjust the location of the fluid interface.

Implementation #17: The system of Implementation #14, wherein an annulus is, defined between a drill string that includes the drill bit and a wall of the subsurface formation, and wherein a buffer zone is created in the annulus between the first type of drilling fluid and the second type of drilling fluid.

Implementation #18: The system of Implementation #17, further comprising: a bottom hole assembly that includes the drill bit, wherein the bottom hole assembly includes at least one stabilizer positioned within the buffer zone.

Implementation #19: The system of Implementation #17, wherein a fluid pill is to be positioned downhole in the buffer zone.

Implementation #20: The system of Implementation #19, wherein the fluid pill is to be circulated at a leading edge of at least one of the first type of drilling fluid or the second type of drilling fluid to be pumped downhole in accordance with a volumetric timing to position the fluid pill in the buffer zone.

Implementation #21: The system of Implementation #19, wherein the fluid pill is to be positioned downhole via at least one of an isolated bladder or a separate tubing.

Implementation #22: The system of Implementation #19, wherein the fluid pill comprises at least one of a viscosified water based pill or a perfluro hydrocarbon-based pill.

Implementation #23: The system of Implementation #19, further comprising: at least one sensor is to be positioned downhole in the wellbore at designated boundaries of the buffer zone, wherein the at least one sensor is to detect a composition of at least one of the fluid pill or the first type of drilling fluid and the second type of drilling fluid, a processor; and one or more computer-readable media including instructions that, when executed by the processor, cause the processor to perform operations, the instructions comprising, instructions to receive the composition that is detected by the at least one sensor; instructions to determine whether the buffer zone has decreased below a threshold based on the detected composition; and instructions to, in response to a determination that the buffer zone has decreased below the threshold, add more fluid to the buffer zone using another fluid pill via at least one of, circulation at a leading edge of at least one of the first type of drilling fluid or the second type of drilling fluid to be pumped downhole in accordance with a volumetric timing to position the fluid pill in the buffer zone or at least one of an isolated bladder or a separate tubing.

Implementation #24: The system of Implementation #17, further comprising: a bladder to be deployed in the buffer zone in the annulus between the first type of drilling fluid and the second type of drilling fluid; and a pump to add or remove fluid from the bladder.

Implementation #25: The system of Implementation #17, wherein a buffer fluid is to be positioned downhole in the buffer zone, wherein the buffer fluid includes ferromagnetic particles.

Implementation #26: The system of Implementation #25, wherein the buffer fluid comprises a magneto-rheological fluid.

Implementation #27: The system of Implementation #25, further comprising a bottom hole assembly that includes the drill bit, wherein the bottom hole assembly comprises a non-magnetic section that includes an electromagnet, wherein the electromagnet is to produce a magnetic field where the buffer zone is to be created.

Implementation #28: The system of Implementation #27, wherein the electromagnet is oriented to be approximately perpendicular to an outer diameter of the bottom hole assembly.

Implementation #29: The system of Implementation #27, wherein the electromagnet is to be controlled electrically via at least one of a power source downhole in the wellbore or from a power source at the surface of the wellbore through a wireline.

Implementation #30: The system of Implementation #27, further comprising: at least one sensor is to be positioned downhole in the wellbore at designated boundaries of the buffer zone, wherein the at least one sensor is to detect a composition of at least one of the buffer fluid or the first type of drilling fluid and the second type of drilling fluid; a processor; and one or more computer-readable media including instructions that, when executed by the processor, cause the processor to perform operations, the instructions comprising, instructions to receive the composition that is detected by the at least one sensor; and instructions to control the electromagnet to activate, deactivate, and adjust a strength of the electromagnet based on the detected composition.

Implementation #31: The system of Implementation #17, wherein a solid material is to be positioned downhole in the buffer zone.

Implementation #32: The system of Implementation #31, wherein the solid material comprises at least one of an elastomer or plastic.

Implementation #33: The system of Implementation #31, wherein the solid material is compressible and wherein an outer diameter of the solid material is greater than an inner diameter of the wellbore.

Implementation #34: The system of Implementation #33, wherein the solid material includes at least one spring element.

Implementation #35: The system of Implementation #31, further comprising: a number of stabilizers to be positioned above and below the solid material.

Implementation #36: The system of Implementation #31, wherein the solid material comprises a packer.

Implementation #37: The system of Implementation #36, wherein the packer is adjustable.

Implementation #38: The system of Implementation #37, wherein the packer is adjustable via hydraulics.

Implementation #39: The system of Implementation #36, wherein the packer includes at least one spring element.

Implementation #40: The system of Implementation #36, wherein the packer is configured to at least partially seal along a wall of the wellbore.

Implementation #41: The system of Implementation #31, wherein the solid material is to be positioned such that there is a leakage of the first type of drilling fluid between the solid material and a wall of the wellbore.

Implementation #42: An apparatus that is part of a drill string for drilling a wellbore in a subsurface formation, the apparatus comprising: a drill bit that includes at least one electrode coupled to a power source, the at least one electrode to periodically emit an electrical discharge based on electrical pulses received from the power source; a first port to output a first type of drilling fluid having a different composition than a second type of drilling fluid to flow downhole for removal of cuttings, wherein the electrical discharge is to be transmitted through the first type of drilling fluid and through a rock of the subsurface formation; a first flow path for flow of the first type of drilling fluid from a surface of the wellbore down and returning from downhole and back to the surface of the wellbore; and a second flow path that is separate from the first flow path and for flow of the second type of drilling fluid from a surface of the wellbore down and returning from downhole and back to the surface of the wellbore.

Implementation #43: The apparatus of Implementation #42, wherein the first flow path includes a path through or around the at least one electrode.

Implementation #44: The apparatus of Implementation #42, wherein the first flow path includes a first inner conduit having an output that is coupled to an input of a bottom hole assembly that includes the drill bit; wherein the second flow path includes a second conduit that is positioned around the first inner conduit and coupled to the bottom hole assembly, wherein the second flow path is to output into an annulus and above the drill bit.

Implementation #45: The apparatus of Implementation #44, wherein the first flow path includes a return path from the bottom hole assembly that includes a first outer conduit such that the first inner conduit is positioned within the first outer conduit.

Implementation #46: The apparatus of Implementation #45, wherein at least the second flow path is to be initially filled with the second type of drilling fluid, wherein the first type of drilling fluid is to be pumped through the first flow path to replace any of the second type of drilling fluid with the first type of drilling fluid in the first flow path.

Implementation #47: The apparatus of Implementation #46, wherein the first inner conduit is also initially filled with the second type of drilling fluid.

Implementation #48: The apparatus of Implementation #47, wherein the return path is also initially filled with the second type of drilling fluid.

Implementation #49: The apparatus of Implementation #42, wherein a volumetric flow rate of the second type of drilling fluid is greater than a volumetric flow rate of the first type of drilling fluid.

Implementation #50: The apparatus of Implementation #42, wherein the first type of drilling fluid has a higher dielectric than a rock of the subsurface formation.

Implementation #51: The apparatus of Implementation #42, wherein the first type of drilling fluid has a higher dielectric than the second type of drilling fluid.

Implementation #52: The apparatus of Implementation #42, wherein an annulus is, defined between a drill string that includes the drill bit and a wall of the subsurface formation, and wherein a buffer zone is created in the annulus between the first type of drilling fluid and the second type of drilling fluid.

Implementation #53: The apparatus of Implementation #52, further comprising, at least one sensor is to be positioned downhole in the wellbore at designated boundaries of the buffer zone, wherein the at least one sensor is to detect a composition of at least one the first type of drilling fluid and the second type of drilling fluid; a processor; and one or more computer-readable media including instructions that, when executed by the processor, cause the processor to perform operations, the instructions comprising, instructions to receive the composition that is detected by the at least one sensor; instructions to determine the composition; instructions to determine a location of a fluid interface between the first type of drilling fluid and the second type of drilling fluid based on the determined composition; and instructions to adjust a pump rate of at least one of the first type of drilling fluid or the second type of drilling fluid to adjust the location of the fluid interface.

Implementation #54: The apparatus of Implementation #52, further comprising: a bottom hole assembly that includes the drill bit, wherein the bottom hole assembly includes at least one stabilizer positioned within the buffer zone.

Implementation #55: The apparatus of Implementation #52, wherein a fluid pill is to be positioned downhole in the buffer zone.

Implementation #56: The apparatus of Implementation #55, wherein the fluid pill is to be circulated at a leading edge of at least one of the first type of drilling fluid or the second type of drilling fluid to be pumped downhole in accordance with a volumetric timing to position the fluid pill in the buffer zone.

Implementation #57: The apparatus of Implementation #55, wherein the fluid pill is to be positioned downhole via at least one of an isolated bladder or a separate tubing.

Implementation #58: The apparatus of Implementation #55, wherein the fluid pill comprises at least one of a viscosified water based pill or a perfluro hydrocarbon-based pill.

Implementation #59: The apparatus of Implementation #55, further comprising: at least one sensor is to be positioned downhole in the wellbore at designated boundaries of the buffer zone, wherein the at least one sensor is to detect a composition of at least one of the fluid pill or the first type of drilling fluid and the second type of drilling fluid, a processor; and one or more computer-readable media including instructions that, when executed by the processor, cause the processor to perform operations, the instructions comprising, instructions to receive the composition that is detected by the at least one sensor; instructions to determine whether the buffer zone has decreased below a threshold based on the detected composition; instructions to, in response to a determination that the buffer zone has decreased below the threshold, add more fluid to the buffer zone using another fluid pill via at least one of, circulation at a leading edge of at least one of the first type of drilling fluid or the second type of drilling fluid to be pumped downhole in accordance with a volumetric timing to position the fluid pill in the buffer zone or at least one of an isolated bladder or a separate tubing.

Implementation #60: The apparatus of Implementation #55, further comprising: a bladder to be deployed in the buffer zone in the annulus between the first type of drilling fluid and the second type of drilling fluid; and a pump to add or remove fluid from the bladder.

Implementation #61: The apparatus of Implementation #52, wherein a buffer fluid is to be positioned downhole in the buffer zone, wherein the buffer fluid includes ferromagnetic particles.

Implementation #62: The apparatus of Implementation #61, wherein the buffer fluid comprises magneto-rheological fluid.

Implementation #63: The apparatus of Implementation #61, further comprising a bottom hole assembly that includes the drill bit, wherein the bottom hole assembly comprises a non-magnetic section that includes an electromagnet, wherein the electromagnet is to produce a magnetic field where the buffer zone is to be created.

Implementation #64: The apparatus of Implementation #63, wherein the electromagnet is oriented to be approximately perpendicular to an outer diameter of the bottom hole assembly.

Implementation #65: The apparatus of Implementation #63, wherein the electromagnet is to be controlled electrically via at least one of a power source downhole in the wellbore or from a power source at the surface of the wellbore through a wireline.

Implementation #66: The apparatus of Implementation #63, further comprising: at least one sensor is to be positioned downhole in the wellbore at designated boundaries of the buffer zone, wherein the at least one sensor is to detect a composition of at least one of the buffer fluid or the first type of drilling fluid and the second type of drilling fluid; a processor; and one or more computer-readable media including instructions that, when executed by the processor, cause the processor to perform operations, the instructions comprising, instructions to receive the composition that is detected by the at least one sensor; and instructions to control the electromagnet to activate, deactivate, and adjust a strength of the electromagnet based on the detected composition.

Implementation #67: The apparatus of Implementation #52, wherein a solid material is to be positioned downhole in the buffer zone.

Implementation #68: The apparatus of Implementation #67, wherein the solid material comprises at least one of an elastomer or plastic.

Implementation #69: The apparatus of Implementation #67, wherein the solid material is compressible and wherein an outer diameter of the solid material is greater than an inner diameter of the wellbore.

Implementation #70: The apparatus of Implementation #69, wherein the solid material includes at least one spring element.

Implementation #71: The apparatus of Implementation #67, further comprising: a number of stabilizers to be positioned above and below the solid material.

Implementation #72: The apparatus of Implementation #67, wherein the solid material comprises a packer.

Implementation #73: The apparatus of Implementation #72, wherein the packer is adjustable.

Implementation #74: The apparatus of Implementation #73, wherein the packer is adjustable via hydraulics.

Implementation #75: The apparatus of Implementation #72, wherein the packer includes at least one spring element.

Implementation #76: The apparatus of Implementation #72, wherein the packer is configured to at least partially seal along a wall of the wellbore.

Implementation #77: The apparatus of Implementation #67, wherein the solid material is to be positioned such that there is a leakage of the first type of drilling fluid between the solid material and a wall of the wellbore.

The invention claimed is:

1. An apparatus that is part of a drill string for drilling a wellbore in a subsurface formation, the apparatus comprising:

a drill bit that includes at least one electrode coupled to a power source, the at least one electrode to periodically emit an electrical discharge based on electrical pulses received from the power source; and a first port to output a first type of drilling fluid having a different composition than a second type of drilling fluid to flow downhole for removal of cuttings, wherein the electrical discharge is to be transmitted through the first type of drilling fluid and through a rock of the subsurface formation, wherein the first type of drilling fluid is to flow through a port on a face of the electrode.

2. The apparatus of claim 1, wherein an additive or a property of at least one of the first type of drilling fluid or the second type of drilling fluid reduces mixability between the first type of drilling fluid and the second type of drilling fluid.

3. The apparatus of claim 2, wherein the property comprises viscosity, wherein the first type of drilling fluid has a higher viscosity than the second type of drilling fluid.

4. The apparatus of claim 1, further comprising a ground structure proximate to the at least one electrode, wherein a return path of the electrical discharge includes the ground structure after the electrical discharge is transmitted through the first type of drilling fluid and the rock of the subsurface formation.

5. The apparatus of claim 1, wherein the second type of drilling fluid is to flow through a second port that is positioned uphole from the first port.

6. A system for pulsed power drilling a wellbore into a subsurface formation, the system comprising:

a drill bit that includes at least one electrode coupled to a power source, the at least one electrode to periodically emit an electrical discharge based on electrical pulses received from the power source; and a first port to output a first type of drilling fluid having a different composition than a second type of drilling fluid to flow downhole for removal of cuttings, wherein the electrical discharge is to be transmitted through the first type of drilling fluid and through a rock of the subsurface formation, wherein an additive or a property of at least one of the first type of drilling fluid or the second type of drilling fluid reduces mixability between the first type of drilling fluid and the second type of drilling fluid.

7. The system of claim 6, wherein the property comprises viscosity, wherein the first type of drilling fluid has a higher viscosity than the second type of drilling fluid.

8. The system of claim 6, wherein the second type of drilling fluid includes the additive that comprises a viscoelastic surfactant.

9. The system of claim 6, wherein the first type of drilling fluid or the second type of drilling fluid comprises a magneto-rheological fluid, wherein the system comprises, a separator to be positioned at or near a surface of the wellbore, wherein the separator is to receive a return fluid that includes the first type of drilling fluid and the second type of drilling fluid from an annulus of the wellbore; and separate, essentially, the return fluid into essentially the first type of drilling fluid and the second type of drilling fluid based on application of a magnetic field.

10. The system of claim 6, wherein the property comprises a pumping rate of the at least one of the first type of drilling fluid or the second type of drilling fluid downhole into the wellbore and out into an annulus, defined between a drill string that includes the drill bit and a wall of the subsurface formation, for a return to a surface of the wellbore, wherein the pumping rate of the at least one of the first type of drilling fluid or the second type of drilling fluid is such that a laminar flow for the at least one of the first type of drilling fluid or the second type of drilling fluid.

11. The system of claim 6, further comprising a downhole valve system configured to alternate a flow of fluid, from downhole via an annulus, defined between a drill string that includes the drill bit and a wall of the subsurface formation, back to a surface of the wellbore, between slugs of the first type of drilling fluid and slugs of the second type of drilling fluid.

12. The system of claim 11, further comprising:

a separator to be positioned at or near a surface of the wellbore, wherein the separator is to receive the first type of drilling fluid and the second type of drilling fluid; and separate, essentially, the first type of drilling fluid from the second type of drilling fluid.

13. The system of claim 12, wherein the separator comprises at least one of centrifuge, settling device, semi-permeable membrane, distillation device, or crystallization device.

14. The system of claim 6, wherein the additive or the property of at least one of the first type of drilling fluid or the second type of drilling fluid that reduces mixability between the first type of drilling fluid and the second type of drilling fluid comprises at least one of viscosity, a viscoelastic surfactant, a magneto-rheological fluid, or a pump rate, wherein the system comprises, a first flow path for flow of the first type of drilling fluid from a surface of the wellbore down and returning from downhole and back to the surface of the wellbore; and a second flow path that is separate from the first flow path and for flow of the second type of drilling fluid from a surface of the wellbore down and returning from downhole and back to the surface of the wellbore.

15. The system of claim 14, further comprising:

a processor; and one or more computer-readable media including instructions that, when executed by the processor, cause the processor to perform operations, the instructions comprising, instructions to increase a flow rate of the second type of drilling fluid as drilling of the wellbore advances to account for more space in an annulus defined between a drill string that includes the drill bit and a wall of the subsurface formation.

16. The system of claim 14, wherein an annulus is, defined between a drill string that includes the drill bit and a wall of the subsurface formation, wherein the system comprises, at least one sensor is to be positioned downhole in the wellbore at designated boundaries of a buffer zone that is created in the annulus between the first type of drilling fluid and the second type of drilling fluid, wherein the at least one sensor is to detect a composition of at least one the first type of drilling fluid and the second type of drilling fluid;

a processor; and one or more computer-readable media including instructions that, when executed by the processor, cause the processor to perform operations, the instructions comprising, instructions to receive the composition that is detected by the at least one sensor;

instructions to determine the composition;

instructions to determine a location of a fluid interface between the first type of drilling fluid and the second type of drilling fluid based on the determined composition; and instructions to adjust a pump rate of at least one of the first type of drilling fluid or the second type of drilling fluid to adjust the location of the fluid interface.

17. The system of claim 14, wherein an annulus is, defined between a drill string that includes the drill bit and a wall of the subsurface formation, and wherein a buffer zone is created in the annulus between the first type of drilling fluid and the second type of drilling fluid.

18. The system of claim 17, further comprising:

a bottom hole assembly that includes the drill bit, wherein the bottom hole assembly includes at least one stabilizer positioned within the buffer zone.

19. The system of claim 17, wherein a fluid pill is to be positioned downhole in the buffer zone.

20. The system of claim 19, wherein the fluid pill is to be circulated at a leading edge of at least one of the first type of drilling fluid or the second type of drilling fluid to be pumped downhole in accordance with a volumetric timing to position the fluid pill in the buffer zone.

21. The system of claim 19, wherein the fluid pill is to be positioned downhole via at least one of an isolated bladder or a separate tubing.

22. The system of claim 19, wherein the fluid pill comprises at least one of a viscosified water based pill or a perfluro hydrocarbon-based pill.

23. The system of claim 19, further comprising:

at least one sensor is to be positioned downhole in the wellbore at designated boundaries of the buffer zone, wherein the at least one sensor is to detect a composition of at least one of the fluid pill or the first type of drilling fluid and the second type of drilling fluid, a processor; and one or more computer-readable media including instructions that, when executed by the processor, cause the processor to perform operations, the instructions comprising, instructions to receive the composition that is detected by the at least one sensor;

instructions to determine whether the buffer zone has decreased below a threshold based on the detected composition; and instructions to, in response to a determination that the buffer zone has decreased below the threshold, add more fluid to the buffer zone using another fluid pill via at least one of, circulation at a leading edge of at least one of the first type of drilling fluid or the second type of drilling fluid to be pumped downhole in accordance with a volumetric timing to position the fluid pill in the buffer zone or at least one of an isolated bladder or a separate tubing.

24. The system of claim 17, further comprising:

a bladder to be deployed in the buffer zone in the annulus between the first type of drilling fluid and the second type of drilling fluid; and a pump to add or remove fluid from the bladder.

25. The system of claim 17, wherein a buffer fluid is to be positioned downhole in the buffer zone, wherein the buffer fluid includes ferromagnetic particles.

26. The system of claim 25, wherein the buffer fluid comprises a magneto-rheological fluid.

27. The system of claim 25, further comprising a bottom hole assembly that includes the drill bit, wherein the bottom hole assembly comprises a non-magnetic section that includes an electromagnet, wherein the electromagnet is to produce a magnetic field where the buffer zone is to be created.

28. The system of claim 27, wherein the electromagnet is oriented to be approximately perpendicular to an outer diameter of the bottom hole assembly.

29. The system of claim 27, wherein the electromagnet is to be controlled electrically via at least one of a power source downhole in the wellbore or from a power source at the surface of the wellbore through a wireline.

30. The system of claim 27, further comprising:

at least one sensor is to be positioned downhole in the wellbore at designated boundaries of the buffer zone, wherein the at least one sensor is to detect a composition of at least one of the buffer fluid or the first type of drilling fluid and the second type of drilling fluid;

a processor; and one or more computer-readable media including instructions that, when executed by the processor, cause the processor to perform operations, the instructions comprising, instructions to receive the composition that is detected by the at least one sensor; and instructions to control the electromagnet to activate, deactivate, and adjust a strength of the electromagnet based on the detected composition.

31. The system of claim 17, wherein a solid material is to be positioned downhole in the buffer zone.

32. The system of claim 31, wherein the solid material comprises at least one of an elastomer or plastic.

33. The system of claim 31, wherein the solid material is compressible and wherein an outer diameter of the solid material is greater than an inner diameter of the wellbore.

34. The system of claim 33, wherein the solid material includes at least one spring element.

35. The system of claim 31, further comprising:

a number of stabilizers to be positioned above and below the solid material.

36. The system of claim 31, wherein the solid material comprises a packer.

37. The system of claim 36, wherein the packer is adjustable.

38. The system of claim 37, wherein the packer is adjustable via hydraulics.

39. The system of claim 36, wherein the packer includes at least one spring element.

40. The system of claim 36, wherein the packer is configured to at least partially seal along a wall of the wellbore.

41. The system of claim 31, wherein the solid material is to be positioned such that there is a leakage of the first type of drilling fluid between the solid material and a wall of the wellbore.

42. An apparatus that is part of a drill string for drilling a wellbore in a subsurface formation, the apparatus comprising:

a drill bit that includes at least one electrode coupled to a power source, the at least one electrode to periodically emit an electrical discharge based on electrical pulses received from the power source;

a first port to output a first type of drilling fluid having a different composition than a second type of drilling fluid to flow downhole for removal of cuttings, wherein the electrical discharge is to be transmitted through the first type of drilling fluid and through a rock of the subsurface formation;

a first flow path for flow of the first type of drilling fluid from a surface of the wellbore down and returning from downhole and back to the surface of the wellbore; and a second flow path that is separate from the first flow path and for flow of the second type of drilling fluid from a surface of the wellbore down and returning from downhole and back to the surface of the wellbore.

43. The apparatus of claim 42, wherein the first flow path includes a path through or around the at least one electrode.

44. The apparatus of claim 42, wherein the first flow path includes a first inner conduit having an output that is coupled to an input of a bottom hole assembly that includes the drill bit;

wherein the second flow path includes a second conduit that is positioned around the first inner conduit and coupled to the bottom hole assembly, wherein the second flow path is to output into an annulus and above the drill bit.

45. The apparatus of claim 44, wherein the first flow path includes a return path from the bottom hole assembly that includes a first outer conduit such that the first inner conduit is positioned within the first outer conduit.

46. The apparatus of claim 45, wherein at least the second flow path is to be initially filled with the second type of drilling fluid, wherein the first type of drilling fluid is to be pumped through the first flow path to replace any of the second type of drilling fluid with the first type of drilling fluid in the first flow path.

47. The apparatus of claim 46, wherein the first inner conduit is also initially filled with the second type of drilling fluid.

48. The apparatus of claim 47, wherein the return path is also initially filled with the second type of drilling fluid.

49. The apparatus of claim 42, wherein a volumetric flow rate of the second type of drilling fluid is greater than a volumetric flow rate of the first type of drilling fluid.

50. The apparatus of claim 42, wherein the first type of drilling fluid has a higher dielectric than a rock of the subsurface formation.

51. The apparatus of claim 42, wherein the first type of drilling fluid has a higher dielectric than the second type of drilling fluid.

52. The apparatus of claim 42, wherein an annulus is, defined between a drill string that includes the drill bit and a wall of the subsurface formation, and wherein a buffer zone is created in the annulus between the first type of drilling fluid and the second type of drilling fluid.

53. The apparatus of claim 52, further comprising, at least one sensor is to be positioned downhole in the wellbore at designated boundaries of the buffer zone, wherein the at least one sensor is to detect a composition of at least one the first type of drilling fluid and the second type of drilling fluid;

a processor; and one or more computer-readable media including instructions that, when executed by the processor, cause the processor to perform operations, the instructions comprising, instructions to receive the composition that is detected by the at least one sensor;

instructions to determine the composition;

instructions to determine a location of a fluid interface between the first type of drilling fluid and the second type of drilling fluid based on the determined composition; and instructions to adjust a pump rate of at least one of the first type of drilling fluid or the second type of drilling fluid to adjust the location of the fluid interface.

54. The apparatus of claim 52, further comprising:

a bottom hole assembly that includes the drill bit, wherein the bottom hole assembly includes at least one stabilizer positioned within the buffer zone.

55. The apparatus of claim 52, wherein a fluid pill is to be positioned downhole in the buffer zone.

56. The apparatus of claim 55, wherein the fluid pill is to be circulated at a leading edge of at least one of the first type of drilling fluid or the second type of drilling fluid to be pumped downhole in accordance with a volumetric timing to position the fluid pill in the buffer zone.

57. The apparatus of claim 55, wherein the fluid pill is to be positioned downhole via at least one of an isolated bladder or a separate tubing.

58. The apparatus of claim 55, wherein the fluid pill comprises at least one of a viscosified water based pill or a perfluro hydrocarbon-based pill.

59. The apparatus of claim 55, further comprising:

at least one sensor is to be positioned downhole in the wellbore at designated boundaries of the buffer zone, wherein the at least one sensor is to detect a composition of at least one of the fluid pill or the first type of drilling fluid and the second type of drilling fluid, a processor; and one or more computer-readable media including instructions that, when executed by the processor, cause the processor to perform operations, the instructions comprising, instructions to receive the composition that is detected by the at least one sensor;

instructions to determine whether the buffer zone has decreased below a threshold based on the detected composition;

instructions to, in response to a determination that the buffer zone has decreased below the threshold, add more fluid to the buffer zone using another fluid pill via at least one of, circulation at a leading edge of at least one of the first type of drilling fluid or the second type of drilling fluid to be pumped downhole in accordance with a volumetric timing to position the fluid pill in the buffer zone or at least one of an isolated bladder or a separate tubing.

60. The apparatus of claim 55, further comprising:

a bladder to be deployed in the buffer zone in the annulus between the first type of drilling fluid and the second type of drilling fluid; and a pump to add or remove fluid from the bladder.

61. The apparatus of claim 52, wherein a buffer fluid is to be positioned downhole in the buffer zone, wherein the buffer fluid includes ferromagnetic particles.

62. The apparatus of claim 61, wherein the buffer fluid comprises magneto-rheological fluid.

63. The apparatus of claim 61, further comprising a bottom hole assembly that includes the drill bit, wherein the bottom hole assembly comprises a non-magnetic section that includes an electromagnet, wherein the electromagnet is to produce a magnetic field where the buffer zone is to be created.

64. The apparatus of claim 63, wherein the electromagnet is oriented to be approximately perpendicular to an outer diameter of the bottom hole assembly.

65. The apparatus of claim 63, wherein the electromagnet is to be controlled electrically via at least one of a power source downhole in the wellbore or from a power source at the surface of the wellbore through a wireline.

66. The apparatus of claim 63, further comprising:

at least one sensor is to be positioned downhole in the wellbore at designated boundaries of the buffer zone, wherein the at least one sensor is to detect a composition of at least one of the buffer fluid or the first type of drilling fluid and the second type of drilling fluid;

a processor; and one or more computer-readable media including instructions that, when executed by the processor, cause the processor to perform operations, the instructions comprising, instructions to receive the composition that is detected by the at least one sensor; and instructions to control the electromagnet to activate, deactivate, and adjust a strength of the electromagnet based on the detected composition.

67. The apparatus of claim 52, wherein a solid material is to be positioned downhole in the buffer zone.

68. The apparatus of claim 67, wherein the solid material comprises at least one of an elastomer or plastic.

69. The apparatus of claim 67, wherein the solid material is compressible and wherein an outer diameter of the solid material is greater than an inner diameter of the wellbore.

70. The apparatus of claim 69, wherein the solid material includes at least one spring element.

71. The apparatus of claim 67, further comprising:

a number of stabilizers to be positioned above and below the solid material.

72. The apparatus of claim 67, wherein the solid material comprises a packer.

73. The apparatus of claim 72, wherein the packer is adjustable.

74. The apparatus of claim 73, wherein the packer is adjustable via hydraulics.

75. The apparatus of claim 72, wherein the packer includes at least one spring element.

76. The apparatus of claim 72, wherein the packer is configured to at least partially seal along a wall of the wellbore.

77. The apparatus of claim 67, wherein the solid material is to be positioned such that there is a leakage of the first type of drilling fluid between the solid material and a wall of the wellbore.

* * * * *